US011003120B2

(12) United States Patent
Tojo et al.

(10) Patent No.: US 11,003,120 B2
(45) Date of Patent: May 11, 2021

(54) FIXING METHOD FOR REGULATING BLADE

(71) Applicant: CANON KABUSHIKI KAISHA, Tokyo (JP)

(72) Inventors: Arata Tojo, Kashiwa (JP); Masafumi Takahashi, Tsukubamirai (JP); Tomohiro Shiomi, Abiko (JP); Shunichi Koga, Abiko (JP); Teruaki Tsurusaki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/698,738

(22) Filed: Nov. 27, 2019

(65) Prior Publication Data

US 2020/0174411 A1 Jun. 4, 2020

(30) Foreign Application Priority Data

Dec. 4, 2018 (JP) ..... JP2018-227473

(51) Int. Cl.
*G03G 21/00* (2006.01)
*G03G 15/20* (2006.01)

(52) U.S. Cl.
CPC ..... *G03G 15/2092* (2013.01); *G03G 21/0011* (2013.01)

(58) Field of Classification Search
None
See application file for complete search history.

(56) References Cited

U.S. PATENT DOCUMENTS

2013/0164043 A1* 6/2013 Watanabe ..... G03G 15/0921 399/269
2019/0171131 A1* 6/2019 Koga ..... G03G 15/0812

FOREIGN PATENT DOCUMENTS

JP 2014197175 A 10/2014
JP 2016095360 A 5/2016
JP 2018045227 A 3/2018
JP 2018116242 A 7/2018

* cited by examiner

*Primary Examiner* — Sevan A Aydin
(74) *Attorney, Agent, or Firm* — Canon U.S.A., Inc. I.P. Division

(57) ABSTRACT

A fixing method of fixing a regulating blade made of a resin to a mounting portion of a developing frame made of a resin so that the regulating blade is in non-contact with a developer carrying member, the fixing method including: imaging the mounting portion; determining a target value of a gap between the developer carrying member and the regulating blade based on characteristic information of a shape of the imaged mounting portion; giving, to the regulating blade, a force for deflecting the regulating blade to adjust a relative position of the regulating blade with respect to the developer carrying member that the gap falls within a predetermined range including the target value over a longitudinal direction of the developer carrying member; and fixing the regulating blade to the mounting portion in a state in which the regulating blade has been deflected and the gap falls within the predetermined range.

10 Claims, 13 Drawing Sheets

FIXING METHOD FOR REGULATING BLADE

BACKGROUND OF THE DISCLOSURE

Field of the Disclosure

The present disclosure relates to a fixing method for a regulating blade made of a resin.

Description of the Related Art

A developing device includes a developing frame, a developer carrying member which is rotatable and is configured to carry developer to develop an electrostatic latent image having been formed on an image bearing member, and a regulating blade serving as a developer regulating member configured to regulate an amount of developer (coating amount) carried on the developer carrying member. The regulating blade is arranged so as to be opposed to the developer carrying member over a longitudinal direction of the developer carrying member through a predetermined gap (hereinafter referred to as "SB gap") between the regulating blade and the developer carrying member. The SB gap is a shortest distance between the developer carrying member and the regulating blade. Through adjustment of sizes of the SB gap, an amount of developer conveyed to a position at which the electrostatic latent image formed on the image bearing member is developed (developing area in which the developer member is opposed to the image bearing member) is adjusted.

In recent years, there has been known a developing device including a developer regulating member made of a resin, which is molded with resin, and a developing frame made of a resin, which is molded with resin (Japanese Patent Application Laid-Open No. 2014-197175).

With regard to the developing device including the regulating blade made of a resin and the developing frame made of a resin, it is conceivable to adopt a configuration in which the regulating blade made of a resin is mounted and fixed to a blade mounting portion of the developing frame made of a resin.

As a width of a sheet on which an image is to be formed becomes larger, a length in a longitudinal direction of an area of the regulating blade corresponding to a maximum image formable area (maximum image formable area of the regulating blade) among image formable areas for images which can be formed on the image bearing member becomes longer. Moreover, as the length in the longitudinal direction of the maximum image formable area of the regulating blade becomes longer, a length in a longitudinal direction of a surface of the blade mounting portion of the developing frame on which the regulating blade is mounted (hereinafter referred to as "blade mounting surface") becomes longer.

When the developing frame having a long length in the longitudinal direction of the blade mounting surface of the developing frame is molded with resin, recesses and protrusions of the blade mounting surface of the developing frame are more liable to become larger. As a result, as a characteristic related to a shape of the blade mounting surface of the developing frame, the flatness (JIS B 0021) of the blade mounting surface of the developing frame tends to become larger. This is because, in general, as a length in a longitudinal direction of a resin molded product becomes longer, variation in flatness is liable to occur depending on positions on the resin molded product along the longitudinal direction. Further, as the flatness of the blade mounting surface of the developing frame becomes larger, a variation amount of relative positions of the regulating blade with respect to a developing sleeve, which include a position at which the regulating blade is closest to the regulating blade, which is determined when the regulating blade is mounted to the blade mounting surface tends to become larger.

As the variation amount of the relative positions of the regulating blade with respect to the developing sleeve, which is determined when the regulating blade is mounted to the blade mounting surface becomes larger, sizes of the SB gap in a state in which the regulating blade is fixed to the blade mounting surface become more liable to differ along the longitudinal direction of the developing sleeve. Further, when the sizes of the SB gap differ along the longitudinal direction of the developing sleeve, unevenness in the amount of developer carried on a surface of the developing sleeve is more liable to occur along the longitudinal direction of the developing sleeve.

In view of the above-mentioned circumstances, in the configuration in which the regulating blade made of a resin is fixed to the blade mounting portion of the developing frame made of a resin, it is required that the SB gap fall within a predetermined range over the longitudinal direction of the developing sleeve irrespective of the flatness of the blade mounting surface. For this purpose, the following configuration is desired. That is, in consideration of a variation amount of relative positions of the regulating blade with respect to the developing sleeve in accordance with a characteristic related to a shape (profile) of the blade mounting surface of the developing frame, a range of an adjustment value for the SB gap being a target at the time of adjusting the sizes of the SB gap is determined.

SUMMARY OF THE DISCLOSURE

The present disclosure has been made in view of the situation described above. An aspect of the present disclosure is to provide a fixing method for a regulating blade, which allows an SB gap to fall within a predetermined range over a longitudinal direction of a developer carrying member in consideration of a characteristic related to a shape of a regulating blade mounting surface of a mounting portion of a developing frame made of a resin to which a regulating blade made of a resin is fixed.

In order to achieve the aspect described above, a fixing method is provided for a regulating blade to be performed for fixing a regulating blade made of a resin. The regulating blade arranged to be in non-contact with a developer carrying member so as to be opposed to the developer carrying member configured to carry developer for developing an electrostatic latent image formed on an image bearing member and configured to regulate an amount of the developer carried on the developer carrying member, to a mounting portion of a developing frame made of a resin. The developing frame includes the mounting portion on which the regulating blade is to be mounted. The fixing method includes imaging the mounting portion; determining a target value of a gap between the developer carrying member supported by the developing frame and the regulating blade mounted on the mounting portion based on characteristic information related to a shape of the mounting portion having been imaged by the imaging; giving, to the regulating blade, a force for deflecting the regulating blade to adjust a relative position of the regulating blade with respect to the developer carrying member supported by the developing frame so that the gap falls within a predetermined range including the target value determined by the determining over a longitudinal direction of the developer carrying member; and fixing the regulating blade to the mounting portion in a state in which the regulating blade has been deflected by the force given to the regulating blade by the giving and in which the gap falls within the predetermined range over the longitudinal direction of the developer carrying member.

Further features and aspects of the present disclosure will become apparent from the following description of example embodiments with reference to the attached drawings.

DESCRIPTION OF THE EMBODIMENTS

Embodiments, various features and aspects of the present disclosure will now herein be described in detail with reference to the accompanying drawings. The following embodiments are not intended to limit the disclosure defined in claims. The present disclosure can be carried out in various usage, such as printers, various printing machines, copying machines, facsimile machines, and multifunctional peripherals, for example.

(Configuration of Example Image Forming Apparatus)

Figure 1:
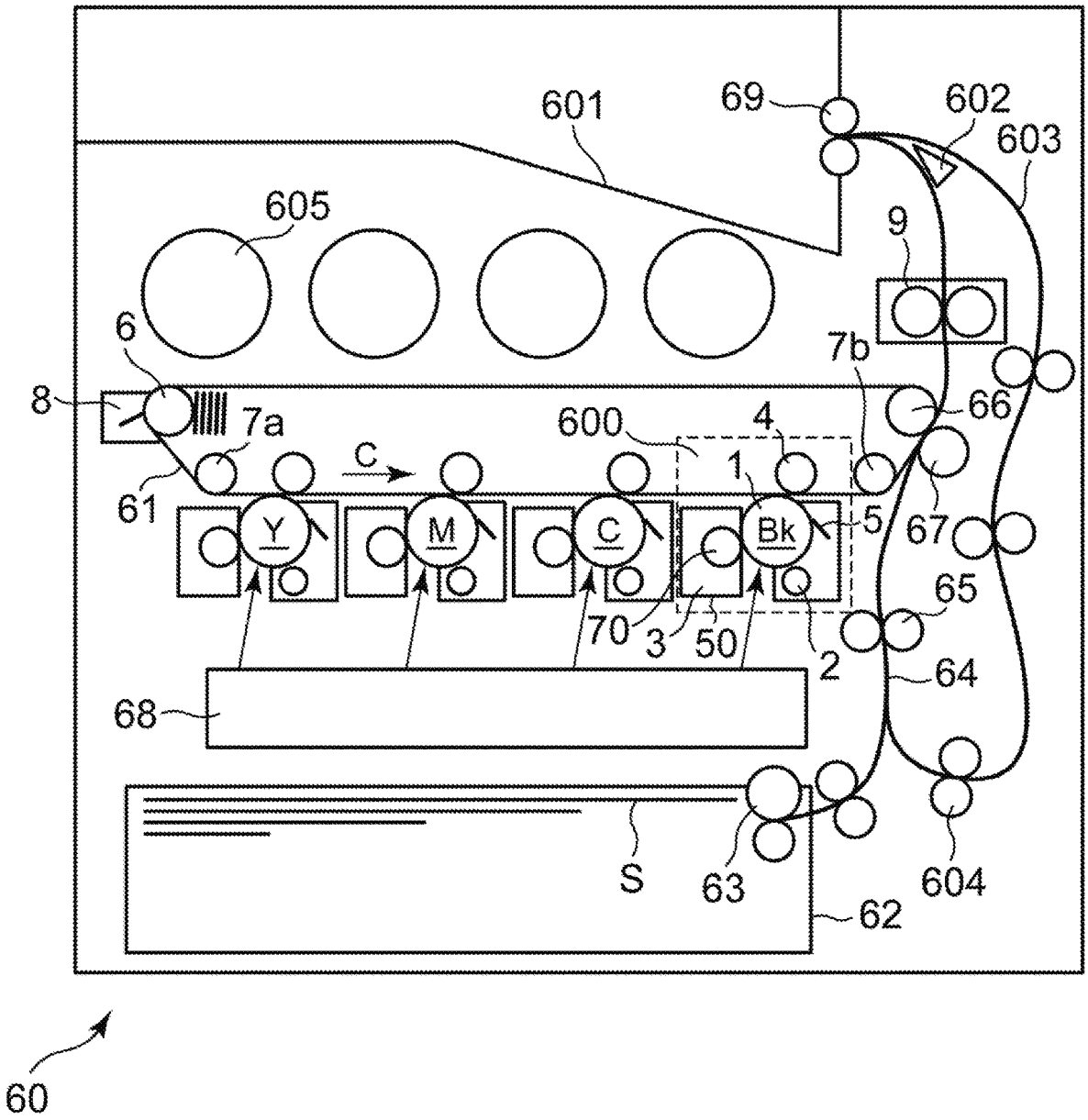
FIG. 1 is a sectional view for illustrating a configuration of an example image forming apparatus.

First, a configuration of an image forming apparatus 60 of the embodiment of the present disclosure is described with reference to a sectional view of FIG. 1. As illustrated in FIG. 1, the image forming apparatus 60 includes an intermediate transfer belt (ITB) 61 and four image forming portions 600. The intermediate belt 61 has an endless shape and serves as an intermediate transfer member. The image forming portions 600 are arranged along a rotation direction of the intermediate transfer belt 61 (direction C indicated by the arrow in FIG. 1) from an upstream side toward a downstream side. The image forming portions 600 are configured to form toner images of yellow (Y), magenta (M), cyan (C), and black (Bk), respectively.

The image forming portion 600 includes a photosensitive drum 1, which is rotatable and serves as an image bearing member. Moreover, the image forming portion 600 includes a charging roller 2 serving as a charging unit, a developing device 3 serving as a developing unit, a primary transfer roller 4 serving as a primary transfer unit, and a photosensitive drum cleaning cleaner 5 serving as a photosensitive drum cleaning unit, which are arranged along the rotation direction of the photosensitive drum 1.

Each of the developing devices 3 is mountable to and removable from the image forming apparatus 60. Each of the developing devices 3 includes a developer container 50 configured to store two-component developer (hereinafter simply referred to as "developer") containing non-magnetic toner (hereinafter simply referred to as "toner") and magnetic carrier. Moreover, each of toner cartridges which store toners of colors Y, M, C, and Bk, respectively, is mountable to and removable from the image forming apparatus 60. The toners of colors Y, M, C, and Bk are supplied to the developer containers 50, respectively, through toner conveyance passages. Details of the developing device 3 are described later with reference to FIG. 2, FIG. 3, and FIG. 4. Details of the developer container 50 are described later with reference to FIG. 4.

The intermediate transfer belt 61 is stretched around a tension roller 6, a driven roller 7*a*, the primary transfer rollers 4, a driven roller 7*b*, and a secondary transfer inner roller 66, and is rotated in the direction C indicated by the arrow in FIG. 1. The secondary transfer inner roller 66 serves also as a driving roller configured to drive the intermediate transfer belt 61. The intermediate transfer belt 61 rotates in the direction C indicated by the arrow in FIG. 1 with rotation of the secondary transfer inner roller 66.

The intermediate transfer belt 61 is pressed by the primary transfer rollers 4 from a back surface side of the intermediate transfer belt 61. Further, with the intermediate transfer belt 61 being held in abutment against the photosensitive drums 1, a primary transfer nip portion serving as a primary transfer portion is defined between the intermediate transfer belt 61 and each of the photosensitive drums 1.

An intermediate transfer member cleaner 8 serving as a belt cleaning unit is held in abutment at a position opposed to the tension roller 6 through intermediation of the intermediate transfer belt 61. Moreover, a secondary transfer outer roller 67 serving as a secondary transfer unit is arranged at a position opposed to the secondary transfer inner roller 66 through intermediation of the intermediate transfer belt 61. The intermediate transfer belt 61 is nipped between the secondary transfer inner roller 66 and the secondary transfer outer roller 67. With this, a secondary transfer nip portion serving as a secondary transfer portion is defined between the secondary transfer outer roller 67 and the intermediate transfer belt 61. A toner image is attracted to a surface of a sheet S (for example, paper or film) at the secondary transfer nip portion through application of a predetermined pressurizing force and a predetermined transfer bias (electrostatic load bias).

Sheets S are stored in a sheet storage portion 62 (for example, feeding cassette or feeding deck) in a state of being stacked. A feeding unit 63 is configured to feed the sheets S in accordance with image formation timings, for example, by a friction separation method using feeding rollers. The sheet S having been sent out by the feeding unit 63 is conveyed to registration rollers 65 arranged on a conveyance path 64. After skew feed correction and timing correction are performed at the registration rollers 65, the sheet S is conveyed to the secondary transfer nip portion. A timing of arrival of the sheet S and a timing of arrival of a toner image match each other at the secondary transfer nip portion, and secondary transfer is performed.

A fixing device 9 is arranged on a downstream side of the secondary transfer nip portion in the conveyance direction of the sheet S. The toner image is melted and fixed on the surface of the sheet S through application of predetermined pressure and heat by the fixing device 9 to the sheet S having been conveyed to the fixing device 9. The sheet S having the image fixed thereon in such a manner is directly delivered to a delivery tray 601 by forward rotation of delivery rollers 69.

When duplex image formation is to be performed, the delivery rollers 69 are reversely rotated after a trailing end of the sheet S has been conveyed by the forward rotation of the delivery rollers 69 to pass through a switching flapper 602. With this, the sheet S is conveyed to a duplex-printing conveyance path 603 with a leading end and the trailing end of the sheet S having been switched. After that, in accordance with the next image formation timing, the sheet S is conveyed by refeeding rollers 604 to the conveyance path 64 again.

(Example Image Forming Process)

At the time of image formation, the photosensitive drum 1 is rotated by a motor. The charging roller 2 uniformly charges, in advance, a surface of the photosensitive drum 1 being rotated. An exposure device 68 is configured to form, based on a signal of image formation input to the image forming apparatus 60, an electrostatic latent image on the surface of the photosensitive drum 1 having been charged by the charging roller 2. The photosensitive drum 1 is capable of forming electrostatic latent images of a plurality of sizes.

The developing device 3 includes a developing sleeve 70, which is rotatable and serves as a developer carrying member configured to carry developer. The developing device 3 is configured to develop, with use of the developer carried on a surface of the developing sleeve 70, the electrostatic latent image having been formed on the surface of the photosensitive drum 1. With this, toner adheres to an exposure portion on the surface of the photosensitive drum 1, thereby forming the electrostatic latent image into a visible image. A transfer bias (electrostatic load bias) is applied to the primary transfer roller 4, and the toner image having been formed on the surface of the photosensitive drum 1 is transferred onto the intermediate transfer belt 61. A small amount of toner which remains on the surface of the photosensitive drum 1 after the primary transfer (transfer residual toner) is collected by the photosensitive drum cleaner 5, and preparation for the next image forming process is performed.

The image forming processes for respective colors to be performed in parallel by the image forming portions 600 for colors of Y, M, C, and Bk are performed at the timing of sequentially superimposing the toner images of respective colors onto toner images of colors on upstream which have been primarily transferred onto the intermediate transfer belt 61. As a result, a toner image of full color is formed on the intermediate transfer belt 61, and the toner image is conveyed to the secondary transfer nip portion. A transfer bias is applied to the secondary transfer outer roller 67, and the toner image having been formed on the intermediate transfer belt 61 is transferred to the sheet S having been conveyed to the secondary transfer nip portion. A small amount of toner which remains on the intermediate transfer belt 61 after the sheet S has passed through the secondary transfer nip portion (transfer residual toner) is collected by the intermediate transfer member cleaner 8. The fixing device 9 is configured to fix the toner image having been transferred onto the sheet S. A recording material S having been subjected to the fixing processing by the fixing device 9 is delivered to the delivery tray 601.

The series of image forming processes described above is terminated, and preparation for the next image forming operation is performed.

(Configuration of Example Developing Device)

Figure 2:
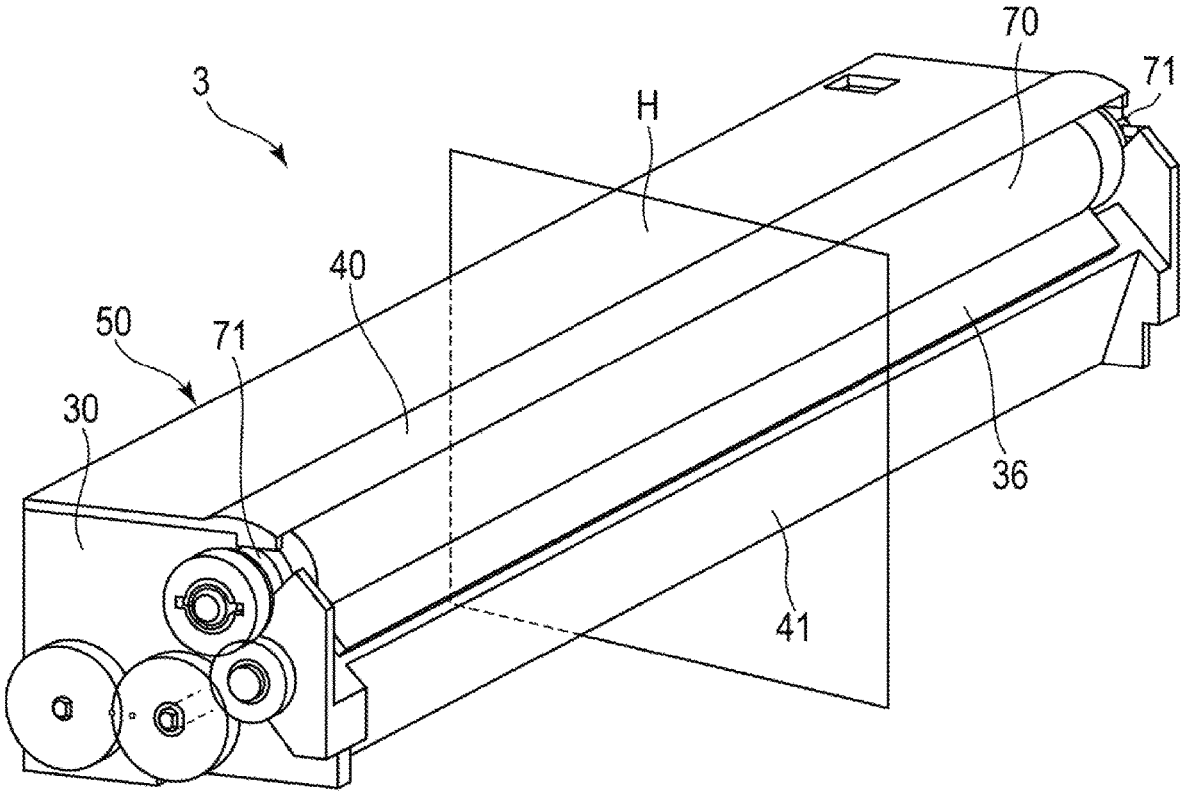
FIG. 2 is a perspective view for illustrating a configuration of an example developing device.
Figure 3:
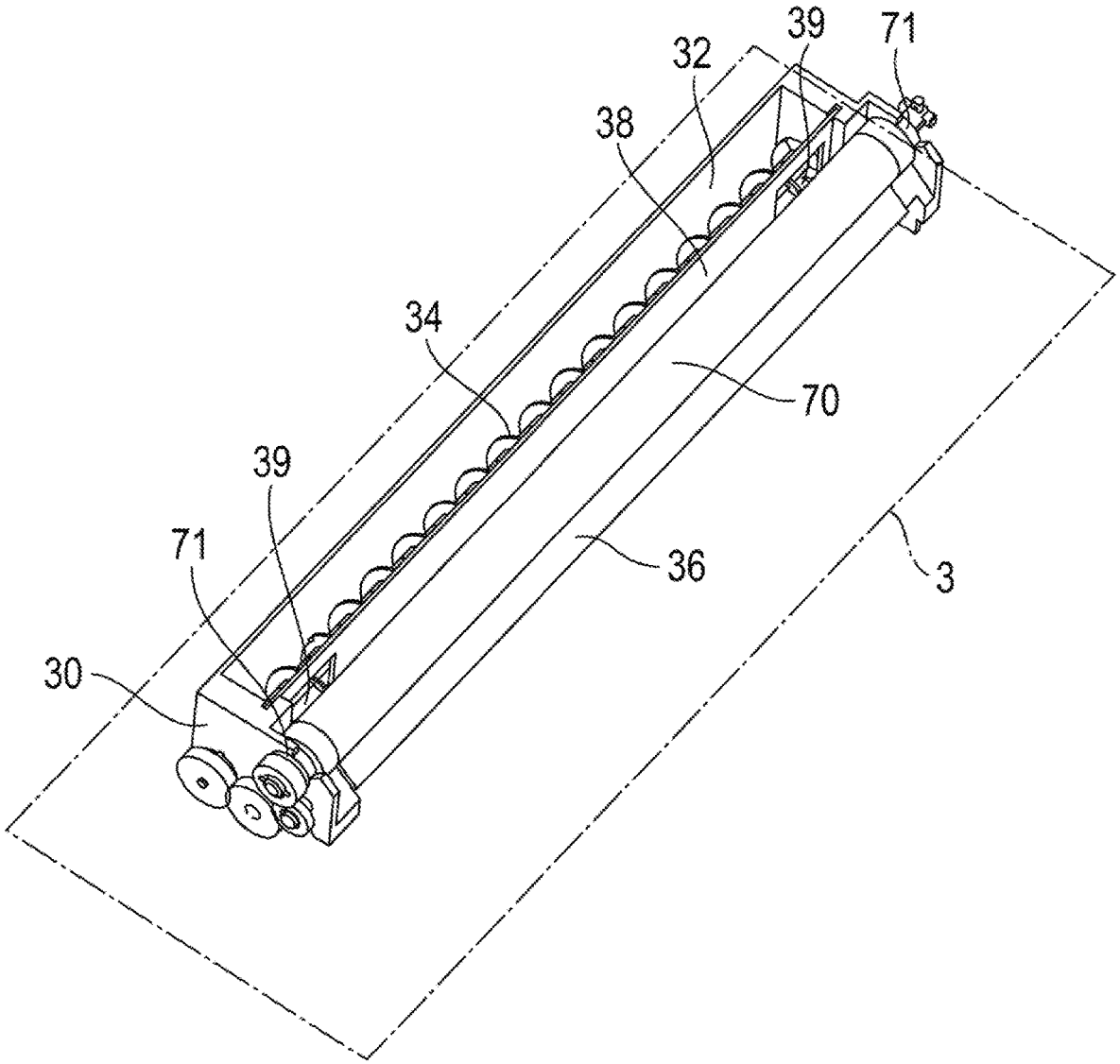
FIG. 3 is a perspective view for illustrating the configuration of the developing device.
Figure 4:
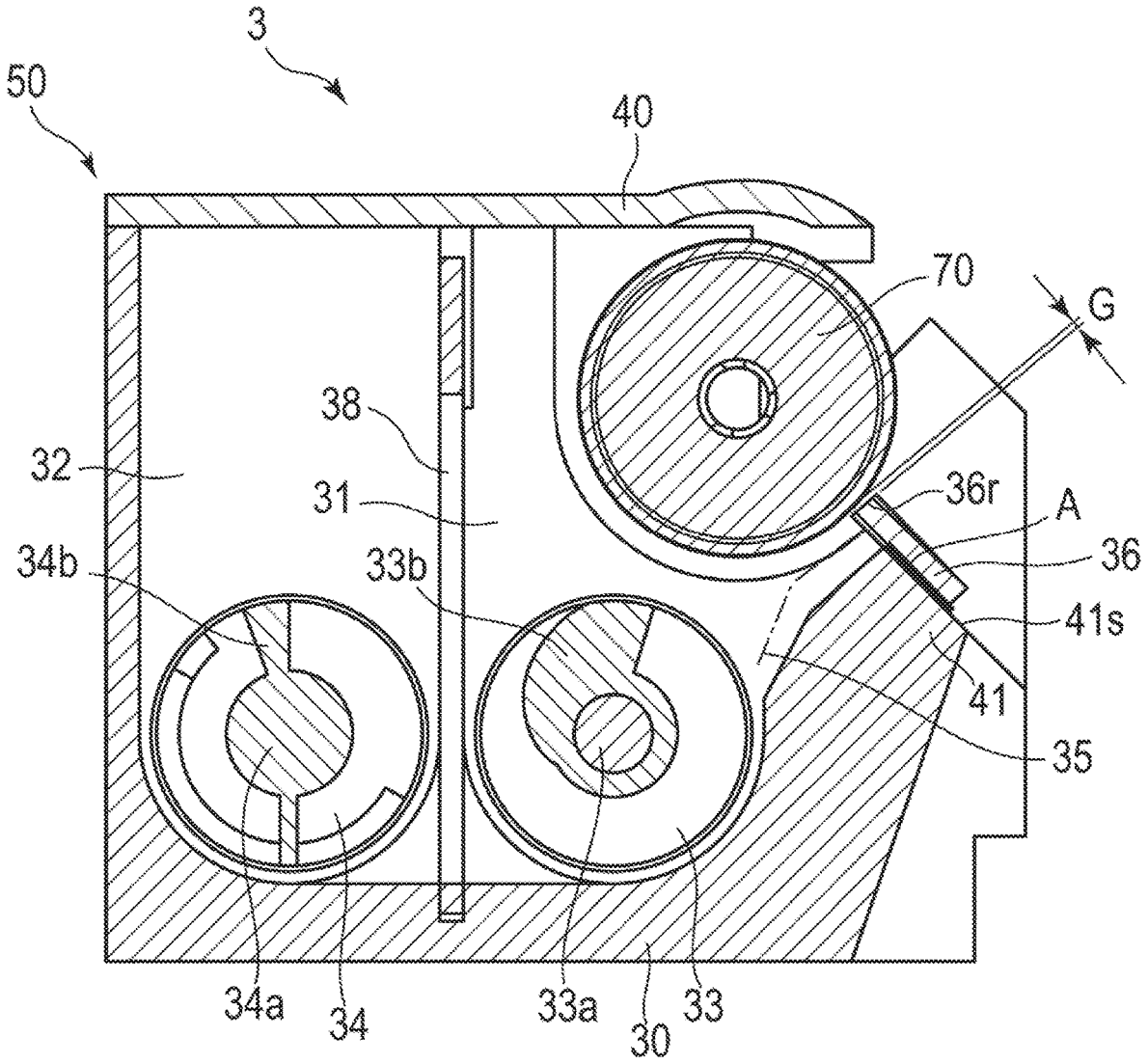
FIG. 4 is a sectional view for illustrating the configuration of the developing device.

Next, a configuration of the developing device according to the embodiment of the present disclosure is described with reference to a perspective view of FIG. 2, a perspective view of FIG. 3, and a sectional view of FIG. 4. FIG. 4 is a sectional view of the developing device 3 at a cross section H of FIG. 2.

The developing device 3 includes a developer container 50. The developer container 50 is formed of a developing frame made of a resin (hereinafter simply referred to as "developing frame 30"), which is molded with resin, and a cover frame member made of a resin (hereinafter simply referred to as "cover frame member 40"), which is formed separately from the developing frame 30 and is molded with resin. FIG. 2 and FIG. 4 are each an illustration of a state in which the cover frame member 40 is mounted to the developing frame 30. FIG. 3 is an illustration of a state in which the cover frame member 40 is not mounted to the developing frame 30. Details of a configuration of the developing frame 30 (alone) are described later with reference to FIG. 6.

The developer container 50 has an opening at a position corresponding to a developing area in which the developing sleeve 70 is opposed to the photosensitive drum 1. The developing sleeve 70 is arranged so as to be rotatable relative to the developer container 50 so that a part of the developing sleeve 70 is exposed at the opening of the developer container 50. Bearings 71 serving as bearing members are provided at both end portions of the developing sleeve 70, respectively.

The inside of the developer container 50 is divided (partitioned) by a partition wall 38, which extends in a vertical direction, into a developing chamber 31 being a first chamber and a stirring chamber 32 being a second chamber. The developing chamber 31 and the stirring chamber 32 are continuous with each other at both ends in a longitudinal direction through two communication portions 39 of the partition wall 38. Therefore, the developer is movable between the developing chamber 31 and the stirring chamber 32 through the communication portions 39. The developing chamber 31 and the stirring chamber 32 are arranged on the right side and the left side in the horizontal direction.

In the developing sleeve 70, a magnet roll is fixedly arranged. The magnetic roll includes a plurality of magnetic poles arranged along a rotation direction of the developing sleeve 70 and serves as a magnetic field generating unit configured to generate a magnetic field for causing the developer to be carried on the surface of the developing sleeve 70. The developer in the developing chamber 31 is drawn up by the influence of the magnetic field generated by the magnetic poles of the magnet roll and is supplied to the developing sleeve 70. The developer is supplied to the developing sleeve 70 from the developing chamber 31 in such a manner, and hence the developing chamber 31 is referred to also as "supply chamber".

In the developing chamber 31, a first conveyance screw 33 serving as a conveyance unit configured to stir and convey the developer in the developing chamber 31 is arranged so as to be opposed to the developing sleeve 70. The first conveyance screw 33 includes a rotation shaft 33*a* and a blade portion 33*b*. The rotation shaft 33*a* serves as a rotatable shaft portion. The blade portion 33*b* has a spiral shape and serves as a developer conveying portion provided along an outer periphery of the rotation shaft 33*a*. The first conveyance screw 33 is supported so as to be rotatable relative to the developer container 50. Bearing members are provided at both end portions of the rotation shaft 33*a*, respectively.

Moreover, in the stirring chamber 32, a second conveyance screw 34 serving as a conveyance unit configured to stir the developer in the stirring chamber 32 and convey the developer in a direction reverse to that of the first conveyance screw 33 is arranged. The second conveyance screw 34 includes a rotation shaft 34*a* and a blade portion 34*b*. The rotation shaft 34*a* serves as a rotatable shaft portion. The blade portion 34*b* has a spiral shape and serves as a developer conveying portion provided along an outer periphery of the rotation shaft 34*a*. The second conveyance screw 34 is supported so as to be rotatable relative to the developer container 50. Bearing members are provided at both end portions of the rotation shaft 34*a*, respectively. Through rotation of the first conveyance screw 33 and the second conveyance screw 34, a circulation path for circulation of the developer through the communication portions 39 is formed between the developing chamber 31 and the stirring chamber 32.

In the developer container 50, a regulating blade (hereinafter referred to as "doctor blade 36") serving as a developer regulating member configured to regulate an amount of developer carried on the surface of the developing sleeve 70 (referred to also as "developer coating amount") is mounted so as to be opposed to the surface of the developing sleeve 70 in a non-contact manner. The doctor blade 36 includes a coating amount regulating surface 36*r* serving as a regulating portion configured to regulate the amount of developer carried on the surface of the developing sleeve 70. The doctor blade 36 is a doctor blade made of a resin, which is molded with resin. A configuration of the doctor blade 36 (alone) is described later with reference to FIG. 5.

The doctor blade 36 is arranged so as to be opposed to the developing sleeve 70 through a predetermined gap (hereinafter referred to as "SB gap G") with respect to the developing sleeve 70 along a longitudinal direction of the developing sleeve 70 (that is, a direction parallel to a rotation axis of the developing sleeve 70). In this disclosure, the SB gap G is a shortest distance between a maximum image formable area of the developing sleeve 70 and a maximum image formable area of the doctor blade 36 at a freely selected position in the longitudinal direction. The maximum image formable area of the developing sleeve 70 is an area of the developing sleeve 70 corresponding to a maximum image formable area among image formable areas for images which can be formed on the surface of the photosensitive drum 1 in the rotation axis direction of the developing sleeve 70 (that is, a maximum image formable area of the developing sleeve 70). Moreover, the maximum image formable area of the doctor blade 36 is an area of the doctor blade 36 corresponding to a maximum image formable area among image formable areas for images which can be formed on the surface of the photosensitive drum 1 in a direction parallel to the rotation axis of the developing sleeve 70. In this embodiment, the photosensitive drum 1 is capable of forming electrostatic latent images of a plurality of sizes, and hence the maximum image formable area represents an image formable area corresponding to a largest size (for example, A3 size) among image formable areas for a plurality of sizes of images which can be formed on the photosensitive drum 1. Meanwhile, in a modification example in which the photosensitive drum 1 is capable of forming an electrostatic latent image of only one size, the maximum image formable area is to be construed as representing the image formable area for the image of the one size which can be formed on the photosensitive drum 1.

The doctor blade 36 is arranged so as to be substantially opposed to a peak position of a magnetic flux density of the magnetic poles of the magnet roll. The developer having been supplied to the developing sleeve 70 is influenced by the magnetic field generated by the magnetic poles of the magnet roll. Moreover, the developer having been regulated and scraped off by the doctor blade 36 tends to stagnate at an upstream portion of the SB gap G. As a result, a developer reservoir is formed on an upstream side with respect to the doctor blade 36 in the rotation direction of the developing sleeve 70. The developer which forms part of the developer reservoir is conveyed so as to pass through the SB gap G with the rotation of the developing sleeve 70. On this occasion, a layer thickness of the developer passing through the SB gap G is regulated by the coating amount regulating surface 36*r* of the doctor blade 36. In such a manner, a thin layer of the developer is formed on the surface of the developing sleeve 70.

A predetermined amount of developer carried on the surface of the developing sleeve 70 is conveyed to the developing area with the rotation of the developing sleeve 70. Thus, thorough adjustment of sizes of the SB gap G, the amount of developer to be conveyed to the developing area is adjusted. In this embodiment, a target size of the SB gap G for adjustment of the sizes of the SB gap G (that is, a target value of the SB gap G) is set to about 300 μm.

The developer having been conveyed to the developing area is caused to stand with a magnetic force in the developing area, thereby forming a magnetic brush. The magnetic brush is brought into contact with the photosensitive drum 1, and causes toner in the developer to be supplied to the photosensitive drum 1. As a result, an electrostatic latent image having been formed on the surface of the photosensitive drum 1 is developed as a toner image. The developer on the surface of the developing sleeve 70 which has passed through the developing area and supplied the toner to the photosensitive drum 1 (hereinafter referred to as "developer after the developing step") is scraped off from the surface of the developing sleeve 70 by a repelling magnetic field formed between magnetic poles having the same polarity in the magnet roll. The developer after the developing step, which has been scraped off from the surface of the developing sleeve 70, falls into the developing chamber 31 to be collected to the developing chamber 31.

As illustrated in FIG. 4, a developer guide portion 35 is provided to the developing frame 30. The developer guide portion 35 is configured to guide developer so that the developer is conveyed to the SB gap G. The developer guide portion 35 and the developing frame 30 are formed integrally with each other, and the developer guide portion 35 and the doctor blade 36 are formed separately from each other. The developer guide portion 35 is formed inside the developing frame 30, and is arranged on an upstream side in the rotation direction of the developing sleeve 70 with respect to the coating amount regulating surface 36*r* of the doctor blade 36. A flow of the developer is stabilized by the developer guide portion 35 to adjust the developer to have a predetermined developer density. Accordingly, a weight of the developer at a position at which the coating amount regulating surface 36*r* of the doctor blade 36 is closest to the surface of the developing sleeve 70 can be defined.

Moreover, as illustrated in FIG. 4, the cover frame member 40 is formed separately from the developing frame 30 and is mounted to the developing frame 30. Moreover, the cover frame member 40 covers a part of the opening of the developing frame 30 so that a part of an outer peripheral surface of the developing sleeve 70 is covered over an entire region of the developing sleeve 70 in a longitudinal direction. On this occasion, the cover frame member 40 covers the part of the opening of the developing frame 30 so that the developing area of the developing sleeve 70 which is opposed to the photosensitive drum 1 is exposed. The cover frame member 40 is fixed to the developing frame 30 by ultrasonic bonding. However, a fixing method for the cover frame member 40 with respect to the developing frame 30 may be any one of methods such as fastening with screws, snap-fitting, bonding, and welding. With regard to the cover frame member 40, the cover frame member 40 may be formed of one component (resin molded product) as illustrated in FIG. 4, or the cover frame member 40 may be formed of a plurality of components (resin molded products).

(Configuration of Example Doctor Blade Made of Resin)

A configuration of the doctor blade 36 (alone) is described with reference to a perspective view of FIG. 5.

During an image forming operation (developing operation), pressure of the developer generated by a flow of the developer (hereinafter referred to as "developer pressure") is applied to the doctor blade 36. As the stiffness of the doctor blade 36 is smaller, when the developer pressure is applied to the doctor blade 36 during the image forming operation, the doctor blade 36 is more liable to be deformed, and the sizes of the SB gap G are more liable to vary. During the image forming operation, the developer pressure is applied to the doctor blade 36 in a widthwise direction (direction M indicated by the arrows in FIG. 5). Thus, in order to suppress the variation in sizes of the SB gap G during the image forming operation, it is desired that the stiffness of the doctor blade 36 in the widthwise direction be increased to increase the strength against deformation of the doctor blade 36 in the widthwise direction.

Figure 5:
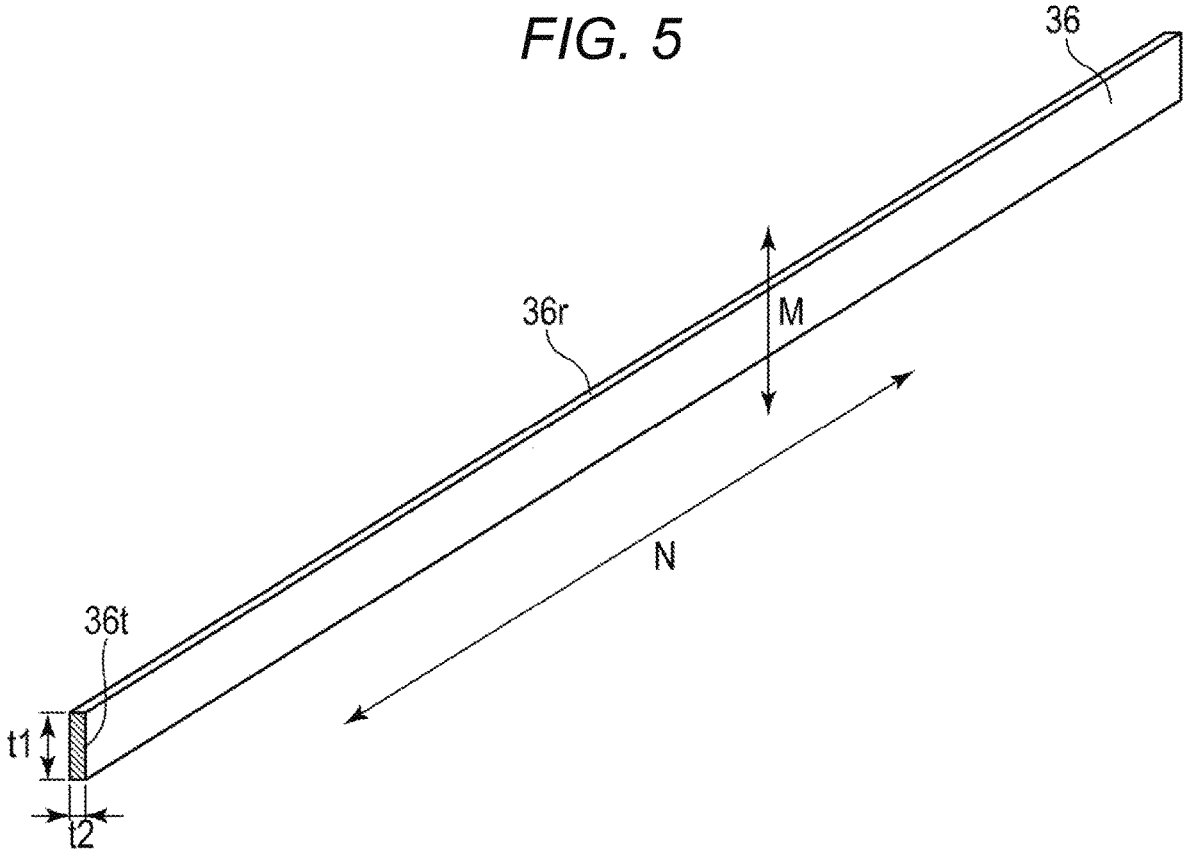
FIG. 5 is a perspective view for illustrating a configuration of an example doctor blade (alone) made of a resin.

As illustrated in FIG. 5, in view of mass production and cost, the shape of the doctor blade 36 is formed into a plate shape. Moreover, as illustrated in FIG. 5, a sectional area of a side surface 36*t* of the doctor blade 36 is set small. Further, a length $t_2$ of the doctor blade 36 in the thickness direction is set smaller than a length $t_1$ of the doctor blade 36 in the widthwise direction. With this, the doctor blade 36 (alone) is liable to be deformed in the widthwise direction (direction M indicated by the arrows in FIG. 5) which is orthogonal to the longitudinal direction of the doctor blade 36 (direction N indicated by the arrows in FIG. 5). Thus, in order to correct straightness of the coating amount regulating surface 36*r*, in a state in which at least a part of the doctor blade 36 is deflected in the direction M indicated by the arrows in FIG. 5, the doctor blade 36 is fixed to a blade mounting portion 41 of the developing frame 30. Details of the straightness correction for the doctor blade 36 are described later with reference to FIG. 11 and subsequent drawings (in particular, FIG. 12).

(Configuration of Example Developing Frame Made of Resin)

Figure 6:
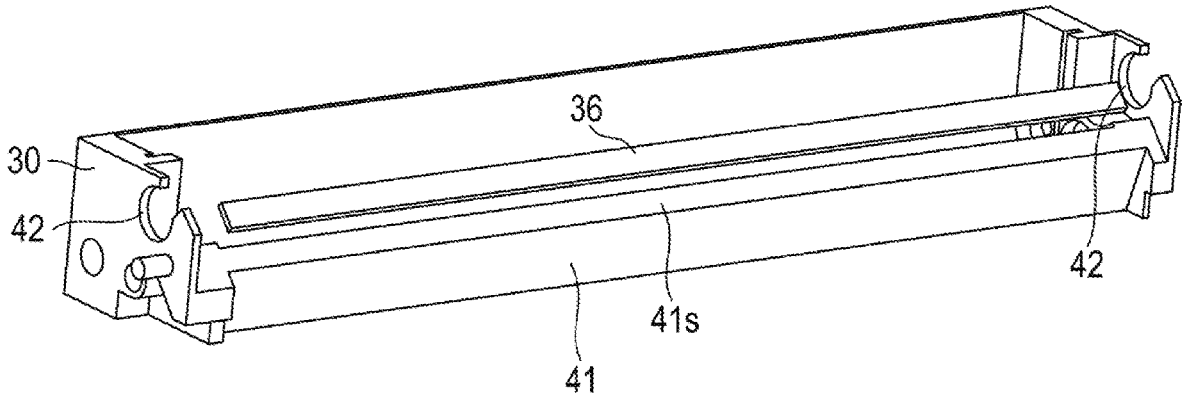
FIG. 6 is a perspective view for illustrating a configuration of an example developing frame (alone) made of a resin.

A configuration of the developing frame 30 (alone) is described with reference to a perspective view of FIG. 6. FIG. 6 is an illustration of a state in which the cover frame member 40 is not mounted to the developing frame 30.

The developing frame 30 includes the developing chamber 31 and the stirring chamber 32 which is divided by the developing chamber 31 and the partition wall 38. The partition wall 38 is molded with resin, and may be formed separately from the developing frame 30 or may be formed integrally with the developing frame 30.

The developing frame 30 includes sleeve supporting portions 42 which are configured to rotatably support the developing sleeve 70 by supporting the bearings 71 which are provided at both end portions of the developing sleeve 70, respectively. Moreover, the developing frame 30 includes the blade mounting portion 41. The blade mounting portion 41 is formed integrally with the sleeve supporting portions 42, and is configured to mount the doctor blade 36 thereon. FIG. 6 is an illustration of an imaginary state in which the doctor blade 36 floats above the blade mounting portion 41.

In a state in which the doctor blade 36 is mounted to the blade mounting portion 41, an adhesive A applied to a blade mounting surface 41*s* of the blade mounting portion 41 is cured. In such a manner, the doctor blade 36 is fixed to the blade mounting portion 41. Details of a method of fixing the doctor blade 36 to the blade mounting portion 41 are described later with reference to FIG. 11 and subsequent drawings (in particular, FIG. 13, FIG. 14A, and FIG. 14B).

(Stiffness of Doctor Blade Made of Resin)

Stiffness of the doctor blade 36 (alone) is described with reference to a schematic view of FIG. 7. The stiffness of the doctor blade 36 (alone) is measured in a state in which the doctor blade 36 is not fixed to the blade mounting portion 41 of the developing frame 30.

Figure 7:
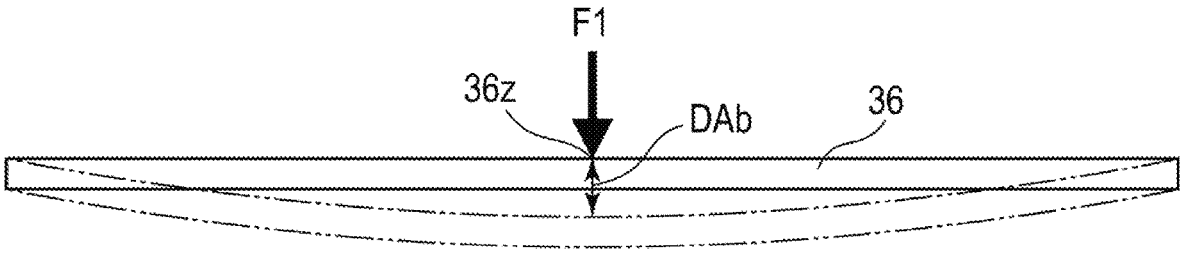
FIG. 7 is a schematic view for illustrating stiffness of the doctor blade (alone) made of a resin.

As illustrated in FIG. 7, an intensive load F is applied in the widthwise direction of the doctor blade 36 at a center portion 36*z* of the doctor blade 36 in the longitudinal direction of the doctor blade 36. On this occasion, the stiffness of the doctor blade 36 (alone) is measured based on a deflection amount of the doctor blade 36 in the widthwise direction at the center portion 36*z* of the doctor blade 36.

For example, it is assumed that the intensive load F1 of 300 gf is applied in the widthwise direction of the doctor blade 36 at the center portion 36*z* of the doctor blade 36 in the longitudinal direction of the doctor blade 36. On this occasion, a deflection amount DAb in the widthwise direction of the doctor blade 36 at the center portion 36*z* of the doctor blade 36 is equal to or larger than 700 μm. On this occasion, a deformation amount at the center portion 36*z* of the doctor blade 36 in cross section is equal to or smaller than 5 μm.

(Stiffness of Developing Frame Made of Resin)

Stiffness of the developing frame 30 (alone) is described with reference to a schematic view of FIG. 8. The stiffness of the developing frame 30 (alone) is measured in a state in which the doctor blade 36 is not fixed to the blade mounting portion 41 of the developing frame 30.

Figure 8:
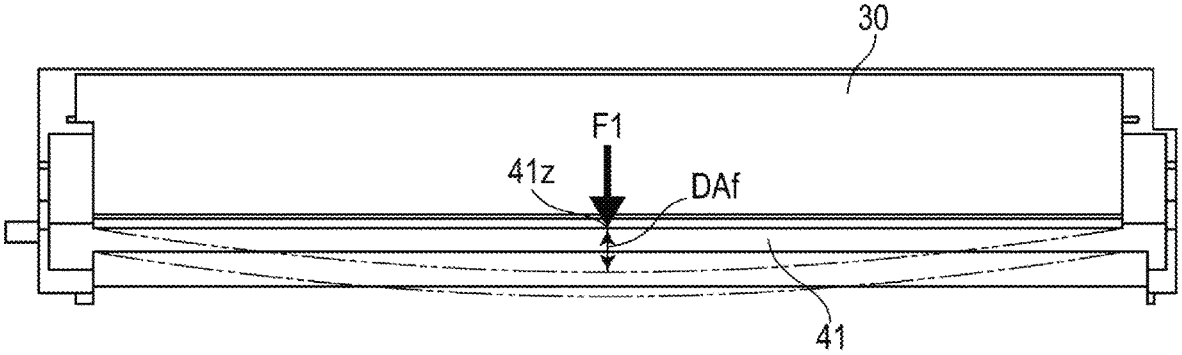
FIG. 8 is a schematic view for illustrating stiffness of the developing frame (alone) made of a resin.

As illustrated in FIG. 8, the intensive load F1 is applied in the widthwise direction of the blade mounting portion 41 at a center portion 41*z* of the blade mounting portion 41 in the longitudinal direction of the blade mounting portion 41. On this occasion, the stiffness of the developing frame 30 (alone) is measured based on a deflection amount of the blade mounting portion 41 in the widthwise direction at the center portion 41*z* of the blade mounting portion 41.

For example, it is assumed that the intensive load F1 of 300 gf is applied in the widthwise direction of the blade mounting portion 41 at the center portion 41*z* of the blade mounting portion 41 in the longitudinal direction of the blade mounting portion 41. On this occasion, a deflection amount DAf in the widthwise direction of the blade mounting portion 41 at the center portion 41*z* of the blade mounting portion 41 is equal to or smaller than 60 μm.

It is assumed that the intensive load F1 having the same magnitude is applied to each of the center portion 36*z* of the doctor blade 36 and the center portion 41*z* of the blade mounting portion 41 of the developing frame 30. The deflection amount DAb at the center portion 36*z* of the doctor blade 36 is equal to or larger than ten times the deflection amount DAf at the center portion 41*z* of the blade mounting portion 41. Thus, the stiffness of the developing frame 30 (alone) is equal to or larger than ten times the stiffness of the doctor blade 36 (alone). Therefore, in the state in which the doctor blade 36 is mounted to the blade mounting portion 41 of the developing frame 30 and in which the doctor blade 36 is fixed to the blade mounting portion 41 of the developing frame 30, the stiffness of the developing frame 30 is dominant over the stiffness of the doctor blade 36. Moreover, when the doctor blade 36 is fixed to the developing frame 30 over the entire region of the maximum image formable area of the doctor blade 36, as compared to the case in which only the both end portions of the doctor blade 36 in the longitudinal direction are fixed, the stiffness of the doctor blade 36 in a state of being fixed to the developing frame 30 is higher.

A magnitude of the stiffness of the developing frame 30 (alone) is larger than a magnitude of the stiffness of the cover frame member 40 (alone). Therefore, in the state in which the cover frame member 40 is mounted to the developing frame 30 and in which the cover frame member 40 is fixed to the developing frame 30, the stiffness of the developing frame 30 is dominant over the stiffness of the cover frame member 40.

(Example Adhesive)

In this embodiment, in the state in which the doctor blade 36 is mounted to the blade mounting portion 41, the adhesive A applied to the blade mounting surface 41*s* of the blade mounting portion 41 is cured. In such a manner, the doctor blade 36 is fixed to the blade mounting portion 41. For selection of the adhesive A, it is required that the adhesive A have a bonding strength to such an extent that the doctor blade 36 is prevented from being removed from the blade mounting surface 41*s* of the developing frame 30 during the image forming operation (developing operation). The load applied to the doctor blade 36 during the image forming operation (developing operation) is about 2 kgf at the time of a falling test, and there arises no problem when the doctor blade 36 is not removed from the blade mounting surface 41*s* of the developing frame 30 by the load having such a magnitude. Therefore, it is known that a sufficient bonding strength can be secured with any adhesive A which is generally available, and in the viewpoint of securing capability for mass production, it is preferred that the curing time for the adhesive A be as short as possible.

Next, a film thickness of the adhesive A applied to the blade mounting surface 41*s* of the developing frame 30 is described. The doctor blade 36 and the blade mounting surface 41*s* of the developing frame 30 are connected to each other with use of the adhesive A, and hence the adhesive A is interposed between the doctor blade 36 and the blade mounting surface 41*s* of the developing frame 30. Therefore, it is required that a film thickness of the adhesive A applied to the blade mounting surface 41*s* be taken into consideration so that the adhesive A interposed between the doctor blade 36 and the blade mounting surface 41*s* of the developing frame 30 does not affect the sizes of the SB gap G.

The film thickness of the adhesive A and a magnitude of a breakage load at a portion bonded with use of the adhesive A are in such a relationship that the bonding strength given by the adhesive A becomes larger as the amount of the adhesive A becomes larger. As mentioned above, the magnitude of the load applied to the doctor blade 36 during the image forming operation (developing operation) is about 2 kgf, and a required strength as the bonding strength given by the adhesive A is set with a margin, that is, set to be equal to or higher than 10 kgf in this embodiment. Thus, in order to secure the bonding strength equal to or higher than 10 kgf as the bonding strength given by the adhesive A, it is only required that the film thickness of the adhesive A applied to the blade mounting surface 41*s* of the developing frame 30 be equal to or larger than 20 μm.

Next, a relationship between a thickness of the adhesive A to be applied and a magnitude of a change in dimension of the adhesive A in the thickness direction is described. In general, as the film thickness of the adhesive A becomes larger, a change in dimension of the adhesive A in the thickness direction caused by contraction of the adhesive A at the time of curing of the adhesive A occurs. Meanwhile, a magnitude of the change in dimension of the adhesive A in the thickness direction, which is determined when the film thickness of the adhesive A is 150 μm is, as compared to a magnitude of the change in dimension of the adhesive A in the thickness direction, which is determined when the film thickness of the adhesive A is 30 μm, larger by about 8 μm. Such a difference of merely about 8 μm as a magnitude of the change in dimension of the adhesive A in the thickness direction is at a level which is negligible in terms of an influence of the change in dimension in a direction orthogonal to the thickness direction of the adhesive A (that is, direction defining the SB gap G). Thus, an upper limit of the film thickness of the adhesive A to be applied to the blade mounting surface 41*s* of the developing frame 30 may be set based on individual production requirements such as curing time for the adhesive A and cost rather than the influence of the contraction of the adhesive A.

(Linear Expansion Coefficient)

Next, deformation of the doctor blade 36 and the developing frame 30 caused by a change in temperature due to heat generated during the image forming operation is described with reference to a perspective view of FIG. 9. Examples of the heat generated during the developing operation include heat generated during rotation of the rotation shaft of the developing sleeve 70 and the bearings 71, heat generated during rotation of the rotation shaft 33*a* of the first conveyance screw 33 and its bearing members, and heat generated at the time of passage of the developer through the SB gap G. Temperature around the developing device 3 changes due to those heats generated during the image forming operation, with the result that the temperatures of the doctor blade 36, the developing frame 30, and the cover frame member 40 also change.

Figure 9:
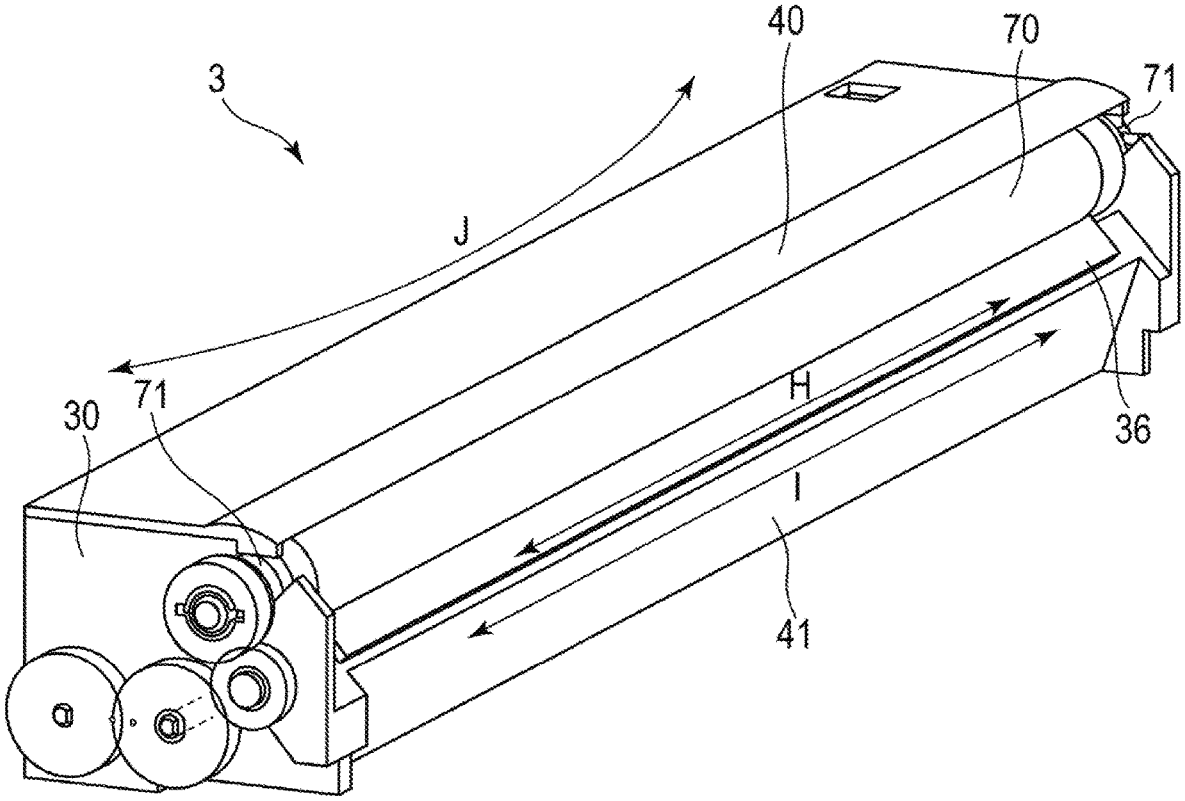
FIG. 9 is a perspective view for illustrating deformation of the doctor blade made of a resin caused by temperature change.

As illustrated in FIG. 9, an extension amount of the doctor blade 36 caused by the temperature change is H [μm], and an extension amount of the blade mounting surface 41*s* of the blade mounting portion 41 of the developing frame 30 caused by the temperature change is I [μm]. Moreover, a linear expansion coefficient $\alpha 1$ of the resin forming the doctor blade 36 and a linear expansion coefficient $\alpha 2$ of the resin forming the developing frame 30 are different from each other. In this case, the difference between the linear expansion coefficients α1 and α2 causes the deformation amount of the developing frame 30 and the deformation amount of the doctor blade 36 caused by the temperature change to be different from each other, and the doctor blade 36 is deformed in the direction J indicated by the arrows in FIG. 9 in order to complement the difference between H [μm] and I [μm]. The deformation of the doctor blade 36 in the direction J indicated by the arrows in FIG. 9 is hereinafter referred to as "deformation in the warping direction of the doctor blade 36". The deformation in the warping direction of the doctor blade 36 may lead to variation in sizes of the SB gap G. For suppression of the variation in sizes of the SB gap G caused by heat, the linear expansion coefficient α2 of the resin forming the developing frame 30 (alone) including the sleeve supporting portions 42 and the blade mounting portion 41 and the linear expansion coefficient α1 of the resin forming the doctor blade 36 (alone) are related. That is, when the linear expansion coefficient α1 of the resin forming the doctor blade 36 and the linear expansion coefficient α2 of the resin forming the developing frame 30 are different from each other, the deformation amounts caused by the temperature change may differ due to the difference in linear expansion coefficient.

In general, a resin material has a linear expansion coefficient larger than that of a metal material. When the doctor blade 36 is made of a resin, the warping deformation occurs in the doctor blade 36 with the temperature change caused by heat generated during the image forming operation, and hence the center portion of the doctor blade 36 in the longitudinal direction is liable to be deflected. As a result, in the developing device in which the doctor blade 36 made of a resin is fixed to the developing frame made of a resin, the sizes of the SB gap G are liable to vary with the temperature change during the image forming operation.

In order to correct the straightness of the coating amount regulating surface 36*r* to be equal to or smaller than 50 μm, at least a part of the maximum image formable area of the doctor blade 36 is deflected. Further, there is adopted a method of fixing the doctor blade 36, in which at least a part of the maximum image formable area of the doctor blade 36 is deflected, to the blade mounting portion 41 of the developing frame 30 over an entire region of the maximum image formable area of the doctor blade 36 with the adhesive A.

On this occasion, in a case in which there is a large difference between the linear expansion coefficient α2 of the resin forming the developing frame 30 and the linear expansion coefficient α1 of the resin forming the doctor blade 36, there arises the following problem when the temperature change occurs. That is, when the temperature change occurs, the deformation amount (extension/contraction amount) of the doctor blade 36 caused by the temperature change and the deformation amount (extension/contraction amount) of the developing frame 30 caused by the temperature change differ. As a result, even when the SB gap G is adjusted with high accuracy at the time of determining a position of mounting the doctor blade 36 to the blade mounting surface 41*s* of the developing frame 30, the sizes of the SB gap G vary due to the temperature change during the image forming operation.

The doctor blade 36 is fixed to the blade mounting surface 41*s* over the entire region of the maximum image formable area, and hence it is required that the variation in sizes of the SB gap G due to the temperature change during the image forming operation be suppressed. It is required that the variation amount of the SB gap G caused by heat be suppressed to be equal to or smaller than ±20 μm in general in order to suppress unevenness of the developer amount carried on the surface of the developing sleeve 70 in the longitudinal direction of the developing sleeve 70.

A difference of the linear expansion coefficient α2 of the resin forming the developing frame 30 including the sleeve supporting portions 42 and the blade mounting portion 41 with respect to the linear expansion coefficient α1 of the resin forming the doctor blade 36 is hereinafter referred to as "linear expansion coefficient difference α2-α1". A change in maximum deflection amount of the doctor blade 36 caused by the linear expansion coefficient difference α2-α1 is described with reference to Table 1. In the state in which the doctor blade 36 is fixed to the blade mounting portion 41 of the developing frame 30 over the entire region of the maximum image formable area of the doctor blade 36, a maximum deflection amount of the doctor blade 36, which is determined when the doctor blade 36 undergoes a temperature change from a normal temperature (23° C.) to a high temperature (40° C.), was measured.

A linear expansion coefficient of the resin forming the developing frame 30 including the sleeve supporting portions 42 and the blade mounting portion 41 is α2 [m/° C.], and a linear expansion coefficient of the resin forming the doctor blade 36 is α1 [m/° C.]. With changes in parameter of the linear expansion coefficient difference α2-α1, measurement of the maximum deflection amount of the doctor blade 36 was conducted for each case, and results thereof are shown in Table 1. In Table 1, the maximum deflection amount was evaluated as "o" when an absolute value of the maximum deflection amount of the doctor blade 36 was equal to or smaller than 20 μm, and the maximum deflection amount was evaluated as "x" when an absolute value of the maximum deflection amount of the doctor blade 36 was larger than 20 μm.

TABLE 1

| | Linear expansion coefficient difference α2 − α1 [×10$^{-5}$ m/° C.] | | | | | | | | |
|---|---|---|---|---|---|---|---|---|---|
| | 0 | +0.20 | +0.40 | +0.50 | +0.54 | +0.55 | +0.56 | +0.57 | +0.60 |
| Maximum deflection amount of doctor blade | ○ | ○ | ○ | ○ | ○ | ○ | x | x | x |

| | Linear expansion coefficient difference α2 − α1 [×10$^{-5}$ m/° C.] | | | | | | | |
|---|---|---|---|---|---|---|---|---|
| | 0 | −0.20 | −0.40 | −0.44 | −0.45 | −0.46 | −0.47 | −0.50 |
| Maximum deflection amount of doctor blade | ○ | ○ | ○ | ○ | ○ | x | x | x |

As can be understood from Table 1, in order to suppress the variation amount of the SB gap G caused by heat to be equal to or smaller than ±20 μm, it is required that the linear expansion coefficient difference α2−α1 satisfy the following relational expression (Expression 1).

$$-0.45\times10^{-5}\ [\text{m/° C.}] \leq \alpha2-\alpha1 \leq 0.55\times10^{-5}\ [\text{m/C}] \qquad \text{(Expression 1)}$$

Thus, it is only required that the resin forming the developing frame 30 and the resin forming the doctor blade 36 be selected so that the linear expansion coefficient difference α2−α1 becomes equal to or larger than −0.45×10$^{-5}$ [m/° C.] and equal to or smaller than 0.55×10$^{-5}$ [m/° C.]. When the same resin is selected as the resin forming the developing frame 30 and the resin forming the doctor blade 36, the linear expansion coefficient difference $\alpha 2-\alpha 1$ is zero.

When the adhesive A is applied to the doctor blade 36 and the developing frame 30, the linear expansion coefficients of the doctor blade 36 and the developing frame 30 having the adhesive A applied thereto are changed. However, a volume of the adhesive A applied to the doctor blade 36 and the developing frame 30 is very small, and is at a level which is negligible in terms of an influence of the temperature change on the change in dimension of the adhesive A in the thickness direction. Therefore, the deformation in the warping direction of the doctor blade 36 caused by the change in linear expansion coefficient difference $\alpha 2-\alpha 1$ when the adhesive A is applied to the doctor blade 36 and the developing frame 30 is at a level which is negligible.

Similarly, the cover frame member 40 is fixed to the developing frame 30, and hence, when the deformation amount of the developing frame 30 due to the temperature change and the deformation amount of the cover frame member 40 due to the temperature change are different from each other, the deformation in a warping direction of the cover frame member 40 may lead to variation in sizes of the SB gap G. A linear expansion coefficient of the resin forming the developing frame 30 including the sleeve supporting portions 42 and the blade mounting portion 41 is $\alpha 2$ [m/° C.], and a linear expansion coefficient of the resin forming the cover frame member 40 is $\alpha 3$ [m/° C.]. Further, a difference of the linear expansion coefficient $\alpha 3$ of the resin forming the cover frame member 40 with respect to the linear expansion coefficient $\alpha 2$ of the resin forming the developing frame 30 including the sleeve supporting portions 42 and the blade mounting portion 41 is hereinafter referred to as "linear expansion coefficient difference $\alpha 3-\alpha 2$". On this occasion, it is required that the linear expansion coefficient difference $\alpha 3-\alpha 2$ satisfy the following relational expression (Expression 2) similarly to Table 1.

$$-0.45\times10^{-5}\ [\text{m/° C.}] \leq \alpha 3-\alpha 2 \leq 0.55\times10^{-5}\ [\text{m/° C.}] \qquad \text{(Expression 2)}$$

Thus, it is only required that the resin forming the developing frame 30 and the resin forming the cover frame member 40 be selected so that the linear expansion coefficient difference $\alpha 3-\alpha 2$ becomes equal to or larger than $-0.45\times10^{-5}$ [m/C] and equal to or smaller than $0.55\times10^{-5}$ [m/C]. When the same resin is selected as the resin forming the developing frame 30 and the resin forming the cover frame member 40, the linear expansion coefficient difference $\alpha 3-\alpha 2$ is zero.

(Developer Pressure)

Figure 10:
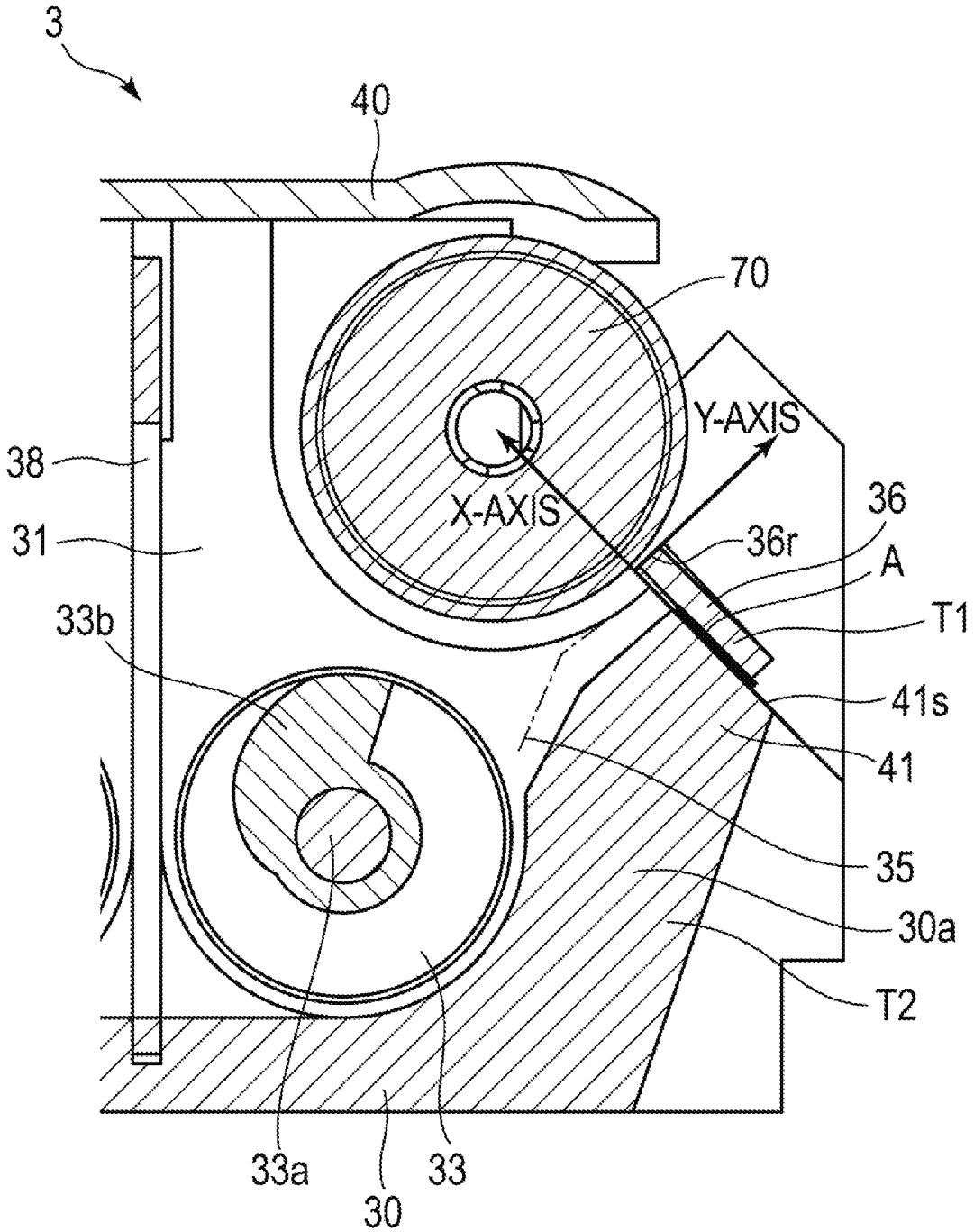
FIG. 10 is a sectional view for illustrating deformation of the doctor blade made of a resin caused by developer pressure.

Next, deformation of the doctor blade 36 caused by application of developer pressure, which is generated by a flow of the developer, to the doctor blade 36 during the image forming operation is described with reference to a sectional view of FIG. 10. FIG. 10 is a sectional view for illustrating the developing device 3 at a cross section orthogonal to the rotation axis of the developing sleeve 70 (cross section H of FIG. 2). Moreover, FIG. 10 is an illustration of a configuration in a vicinity of the doctor blade 36 fixed by the adhesive A to the blade mounting portion 41 of the developing frame 30.

As illustrated in FIG. 10, a line connecting a closest position of the coating amount regulating surface 36*r* with respect to the developing sleeve 70 of the doctor blade 36 to a rotation center of the developing sleeve 70 is an X-axis. On this occasion, the doctor blade 36 has a long length in an X-axis direction and has high stiffness in terms of the sectional shape in the X-axis direction. Moreover, as illustrated in FIG. 10, a ratio of a sectional area T1 of the doctor blade 36 occupying a sectional area T2 of a wall portion 30*a* of the developing frame 30 located in the vicinity of the developer guide portion 35 is small.

As described above, the stiffness of the developing frame 30 (alone) is set so as to be equal to or larger than ten times the stiffness of the doctor blade 36 (alone). Thus, in the state in which the doctor blade 36 is fixed to the blade mounting portion 41 of the developing frame 30, the stiffness of the developing frame 30 is dominant over the doctor blade 36. As a result, a displacement amount (maximum deflection amount) of the coating amount regulating surface 36*r* of the doctor blade 36, which is determined when the doctor blade 36 receives the developer pressure during the image forming operation is substantially equivalent to a displacement amount (maximum deflection amount) of the developing frame 30.

The developer having been drawn up from the first conveyance screw 33 during the image forming operation is conveyed to the surface of the developing sleeve 70 through the developer guide portion 35. After that, also when the layer thickness of the developer is defined in the size of the SB gap G by the doctor blade 36, the doctor blade 36 receives the developer pressure from various directions. As illustrated in FIG. 10, when a direction orthogonal to the X-axis direction (direction of defining the SB gap G) is a Y-axis direction, the developer pressure in the Y-axis direction is perpendicular to the blade mounting surface 41*s* of the developing frame 30. That is, the developer pressure in the Y-axis direction serves as a force in a direction of scraping off the doctor blade 36 from the blade mounting surface 41*s*. Thus, it is required that a connection force applied by the adhesive A be sufficiently large with respect to the developer pressure in the Y-axis direction. Therefore, in consideration of the force of scraping off the doctor blade 36 from the blade mounting surface 41*s* by the developer pressure and an adhesion force applied by the adhesive A, an adhesion area and an application thickness of the adhesive A with respect to the blade mounting surface 41*s* are optimized.

(Straightness Correction for Doctor Blade Made of Resin)

As a width of a sheet S becomes larger, such as when a width of a sheet S on which an image is to be formed corresponds to the A3 size, a length of the maximum image formable area among the image formable areas for images which can be formed on the surface of the photosensitive drum 1 in a direction parallel to the rotation axis of the developing sleeve 70 becomes larger. Therefore, as the width of the sheet S on which the image is to be formed becomes larger, the length of the maximum image formable area of the doctor blade 36 becomes larger. When the doctor blade having a long length in the longitudinal direction is molded with resin, it is difficult to assure the straightness of the coating amount regulating surface of the doctor blade made of a resin, which is molded with resin. This is because of the following reason. In a case in which the doctor blade having a long length in the longitudinal direction is to be molded with resin, when the thermally expanded resin is thermally contracted, locations at which the thermal contraction advances and locations at which the thermal contraction delays are liable to be formed depending on positions of the doctor blade in the longitudinal direction.

Therefore, with the doctor blade made of a resin, there is a tendency that, as the length in the longitudinal direction of the doctor blade becomes larger, the SB gap is liable to differ in the longitudinal direction of the developer carrying member due to the straightness of the coating amount regulating surface of the doctor blade. When the SB gap differs in the longitudinal direction of the developer carrying member, unevenness is liable to occur in the amount of developer carried on the surface of the developer carrying member in the longitudinal direction of the developer carrying member.

For example, when a doctor blade made of a resin having a length in the longitudinal direction adaptable to the A3 size (hereinafter referred to as "doctor blade made of a resin adaptable to the A3 size") is produced with an accuracy required for a general resin molded product, the straightness of the coating amount regulating surface is from about 300 μm to about 500 μm. Moreover, when the doctor blade made of a resin adaptable to the A3 size is produced with high accuracy using a resin material having high accuracy, the straightness of the coating amount regulating surface is from about 100 μm to about 200 μm.

In this embodiment, the size of the SB gap G is set to about 300 μm, and a tolerance of the SB gap G (that is, tolerance of the SB gap G with respect to a target value) is set to be equal to or smaller than ±10%. Thus, in this embodiment, it means that an adjustment value for the SB gap G is 300 μm±30 μm, and an allowable tolerance for the SB gap G is 60 μm at maximum. Therefore, even when the doctor blade made of a resin adaptable to the A3 size is produced with an accuracy required for a general resin molded product or is produced with high accuracy using the resin material having high accuracy, the SB gap G exceeds the allowable tolerance for the SB gap G only with the accuracy of the straightness of the coating amount regulating surface.

With regard to the developing device including the doctor blade made of a resin, irrespective of the straightness of the coating amount regulating surface of the doctor blade alone, it is desired that, in the state in which the doctor blade is fixed to the blade mounting portion, the SB gap G fall within a predetermined range over the longitudinal direction of the developing sleeve. Therefore, in this embodiment, even when the doctor blade made of a resin having a low straightness of the coating amount regulating surface is used, the straightness of the coating amount regulating surface is corrected by applying a force of deflecting the doctor blade to the doctor blade. With this, in the state in which the doctor blade made of a resin is fixed to the blade mounting portion of the developing frame made of a resin, the SB gap G is set so as to fall within the predetermined range over the longitudinal direction of the developing sleeve (direction parallel to the rotation axis of the developing sleeve).

(Fixing Method for Doctor Blade According to this Embodiment)

As described above, with regard to the developing device including the doctor blade 36 made of a resin and the developing frame 30 made of a resin, it is conceivable to adopt a configuration of mounting and fixing the doctor blade 36 made of a resin to the blade mounting portion 41 of the developing frame 30 made of a resin.

Moreover, as described above, as the width of the sheet S on which an image is to be formed becomes larger, the length in the longitudinal direction of the maximum image formable area of the doctor blade 36 becomes longer. Moreover, as the length in the longitudinal direction of the maximum image formable area of the doctor blade 36 becomes longer, the length in the longitudinal direction of the blade mounting surface 41*s* becomes longer.

When the developing frame 30 having a long length in the longitudinal direction of the blade mounting surface 41*s* is molded with resin, the recesses and protrusions of the blade mounting surface 41*s* are liable to be large. As a result, as a characteristic related to a shape (profile) of the blade mounting surface 41*s*, the flatness (JIS B 0021) of the blade mounting surface 41*s* tends to become larger. This is because of the following reason. In general, as the length in the longitudinal direction of the resin molded product becomes longer, variation in flatness is more liable to occur depending on positions on the resin molded product along the longitudinal direction. Further, as the flatness of the blade mounting surface 41*s* becomes larger, a variation amount of relative positions of the doctor blade 36 with respect to the developing sleeve 70, which is determined when the doctor blade 36 is mounted to the blade mounting surface 41*s* tends to be larger. The relative position of the doctor blade 36 with respect to the developing sleeve 70, which is determined when the doctor blade 36 is mounted to the blade mounting surface 41*s*, includes a position at which the doctor blade 36 is closest to the developing sleeve 70.

Now, consideration is made of a case in which a variation amount of the relative positions of the doctor blade 36 with respect to the developing sleeve 70, which is determined when the doctor blade 36 is mounted to the blade mounting surface 41*s*, is large. As the variation amount of the relative positions of the doctor blade 36 with respect to the developing sleeve 70 becomes larger, the sizes of the SB gap G in the state in which the doctor blade 36 is fixed to the blade mounting surface 41*s* are more liable to differ in the longitudinal direction of the developing sleeve 70. When the sizes of the SB gap G differ in the longitudinal direction of the developing sleeve 70, unevenness in the amount of developer carried on the surface of the developing sleeve 70 in the longitudinal direction of the developing sleeve 70 is liable to occur.

Therefore, in the configuration in which the doctor blade 36 made of a resin is fixed to the blade mounting portion 41 of the developing frame 30 made of a resin, it is required that, irrespective of the flatness of the blade mounting surface 41*s*, the SB gap G be set so as to fall within the predetermined range over the longitudinal direction of the developing sleeve 70.

Therefore, in this embodiment, the following configuration is adopted. Consideration is made of the variation amount of the relative positions of the regulating blade with respect to the developing sleeve in accordance with a characteristic related to a shape (profile) of the blade mounting surface of the developing frame. Further, in this configuration, a range of an adjustment value for the SB gap G as a target (target value of SB gap G), which is determined when the sizes of the SB gap G are to be adjusted, is determined based on characteristic information related to the shape of the blade mounting surface of the developing frame. That is, provided is a fixing method for a regulating blade which allows the SB gap G to fall within a predetermined range over the longitudinal direction of the developer carrying member in consideration of a characteristic related to a shape of a surface of the mounting portion of the developing frame made of a resin, to which the regulating blade made of a resin is fixed, on which the regulating blade is mounted. In the following, details thereof are described.

In this embodiment, the method described below is used to determine whether the SB gap G falls within the predetermined range over the direction parallel to the rotation axis of the developing sleeve 70. First, the maximum image formable area of the doctor blade 36 is divided into four or more segments at equal intervals, and the SB gap G is measured in each of the segment portions of the doctor blade 36 (at five or more positions including both end portions and a center portion of the maximum image formable area of the doctor blade 36). After that, a maximum value of the SB gap G, a minimum value of the SB gap G, and a median value of the SB gap G are extracted from samples of measurement values of the SB gap G measured at five or more positions. On this occasion, it is only required that an absolute value of a difference between the maximum value of the SB gap G and the median value of the SB gap G be equal to or smaller than 10% of the median value of the SB gap G and that an absolute value of a difference between the minimum value of the SB gap G and the median value of the SB gap G be equal to or smaller than 10% of the median value of the SB gap G. In this case, with the tolerance of the SB gap G being equal to or smaller than ±10%, the SB gap G satisfies the condition of falling within the predetermined range over the direction parallel to the rotation axis of the developing sleeve 70. For example, when the median value (target value) of the SB gap G is 300 μm from the samples of measurement values of the SB gap G measured at five or more positions, it is only required that the maximum value of the SB gap G be equal to or smaller than 330 μm and that the minimum value of the SB gap G be equal to or larger than 270 μm. That is, in this case, the adjustment value of the SB gap G is 300 μm±30 μm, and the allowable tolerance of the SB gap G is 60 μm at maximum.

Now, with reference to schematic views of FIG. 11, FIG. 12, FIG. 13, FIG. 14A, and FIG. 14B, steps of the fixing method for the doctor blade 36 are described. An external device (hereinafter simply referred to as "device 100") is configured to perform the steps of the fixing method for the doctor blade 36 described below.

First, the device 100 detects an outer shape of the coating amount regulating surface 36*r* of the doctor blade 36. Next, with regard to the outer shape of the coating amount regulating surface 36*r* in the longitudinal direction of the coating amount regulating surface 36*r*, the device 100 identifies the straightness of the coating amount regulating surface 36*r* using a center portion of the coating amount regulating surface 36*r* (distal end portion 36*e*3 of the doctor blade 36) as a reference. In the steps of the fixing method for the doctor blade 36, a doctor blade made of a resin, which is produced with an accuracy required for a general resin molded product and is adaptable to the A3 size, is used. Therefore, the device 100 identifies that the straightness of the coating amount regulating surface 36*r* is from about 300 μm to about 500 μm. Then, the device 100 deflects at least a part of the area corresponding to the maximum image formable area of the doctor blade 36 with use of a force applied to the doctor blade 36. After that, the device 100 corrects the straightness of the coating amount regulating surface 36*r* to be equal to or smaller than 50 μm (hereinafter referred to as "deflecting step").

Next, the device 100 determines a position at which the doctor blade 36, in which at least a part of the area corresponding to the maximum image formable area is deflected in the deflecting step, is fixed to the blade mounting portion 41 of the developing frame 30 so that the SB gap G falls within the predetermined range (hereinafter referred to as "positioning step"). Next, in the state in which the part of the area corresponding to the maximum image formable area of the doctor blade 36 is deflected, the device 100 fixes the part of the area corresponding to the maximum image formable area of the doctor blade 36 at the predetermined position of the blade mounting portion 41 determined in the positioning step (hereinafter referred to as "fixing step").

The device 100 includes a placement base 103 for placing the doctor blade 36 (alone) thereon. Moreover, the device 100 includes fingers 101 (101*p*1, 101*p*2, 101*p*3, 101*p*4, and 101*p*5) located at five positions, which are configured to hold grip portions 37 (37*p*1, 37*p*2, 37*p*3, 37*p*4, and 37*p*5) provided at five positions in the area corresponding to the maximum image formable area of the doctor blade 36. The fingers 101 (101*p*1 to 101*p*5) are independently movable in the direction J of FIG. 11 and are capable of proceeding and retreating in the direction J of FIG. 11.

Moreover, the device 100 includes cameras 102 (102*p*1, 102*p*2, 102*p*3, 102*p*4, and 102*p*5) located at five positions, which are configured to measure positions of distal end portions 36*e* (36*e*1, 36*e*2, 36*e*3, 36*e*4, and 36*e*5) located at five positions and included in the coating amount regulating surface 36*r* of the doctor blade 36. The cameras 102 (102*p*1 to 102*p*5) are arranged along a direction (direction F indicated by the arrows in FIG. 11) toward the distal end portions 36*c* (36*e*1 to 36*e*5) of the doctor blade 36. The cameras 102 (102*p*1 to 102*p*5) measure positions of the distal end portions 36*c* (36*e*1 to 36*e*5) of the doctor blade 36, to thereby detect an outer shape of the coating amount regulating surface 36*r* of the doctor blade 36. Next, with regard to the outer shape of the coating amount regulating surface 36*r* in the longitudinal direction of the coating amount regulating surface 36*r*, the device 100 identifies the straightness of the coating amount regulating surface 36*r* using the center portion of the coating amount regulating surface 36*r* (distal end portion 36*e*3 of the doctor blade 36) as a reference. In the following, an example of measurement of the positions of the distal end portions 36*e* (36*e*1 to 36*c*5) of the doctor blade 36 with use of the cameras 102 (102*p*1 to 102*p*5) is described. However, in a modification example, the measurement may be performed with use of a non-contact type sensor.

The doctor blade 36 is produced with an accuracy required for a general resin molded product. As described above, when the doctor blade made of a resin which is adaptable to the A3 size is produced with the accuracy required for a general resin molded product, the straightness of the coating amount regulating surface is from about 300 Lm to about 500 μm. The doctor blade 36 is a doctor blade made of a resin which is adaptable to the A3 size, and is produced with the accuracy required for a general resin molded product. In this case, in the state in which the doctor blade 36 is placed on the placement base 103, when the positions of the distal end portions 36*e* (36*e*1 to 36*e*5) of the doctor blade 36 located at five positions are measured with the cameras 102 (102*p*1 to 102*p*5), there is given a difference of from about 300 μm to about 500 μm. Meanwhile, as described above, in order to suppress the unevenness in developer amount carried on the surface of the developing sleeve 70 in the longitudinal direction of the developing sleeve 70, the tolerance of the SB gap G is set to be equal to or smaller than ±10%.

Thus, in view of an allowable value of the tolerance of the SB gap G and a mounting accuracy of the doctor blade 36 with respect to the developing frame 30, it is required that the straightness of the distal end portions 36*e*1 to 36*e*5 of the doctor blade 36 (that is, straightness of the coating amount regulating surface 36*r*) be corrected to be equal to or smaller than 50 μm. In view of the fact that the accuracy of the straightness of the doctor blade made of metal given as a result of secondary machining is equal to or smaller than 20 μm, it is more preferred that the straightness of the coating amount regulating surface 36*r* of the doctor blade 36 made of a resin be corrected to be equal to or smaller than 20 μm.

Next, in the following, details of a series of steps (deflecting step, positioning step, and fixing step) of the fixing method for the doctor blade 36 is described.

(1) Deflecting Step

First, details of the deflecting step are described with reference to the schematic view of FIG. 11. The device 100 holds the grip portions 37 (37*p*1 to 37*p*5) of the doctor blade 36 with use of the fingers 101 (101*p*1 to 101*p*5), to thereby hold the doctor blade 36. Next, the cameras 102 (102*p*1 to 102*p*5) measure positions of the distal end portions 36*e* (36*e*1 to 36*e*5) of the doctor blade 36 in the state in which the grip portions 37 (37*p*1 to 37*p*5) of the doctor blade 36 are held with use of the fingers 101 (101*p*1 to 101*p*5). In such a manner, the device 100 detects an outer shape of the coating amount regulating surface 36*r* of the doctor blade 36. Next, with regard to the outer shape of the coating amount regulating surface 36*r* in the longitudinal direction of the coating amount regulating surface 36*r*, the device 100 identifies the straightness of the coating amount regulating surface 36*r* using the center portion of the coating amount regulating surface 36*r* (distal end portion 36*e*3 of the doctor blade 36) as a reference.

Figure 11:
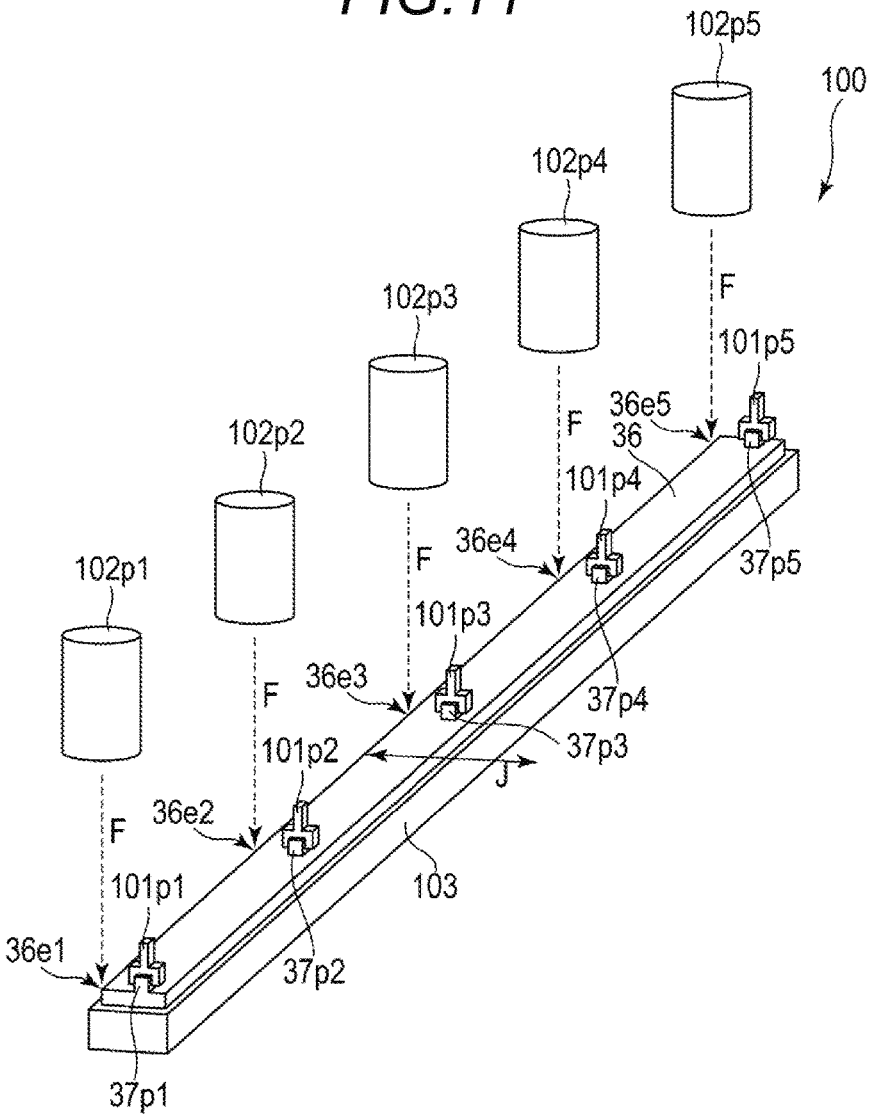
FIG. 11 is a schematic view for illustrating one step of an example fixing method for a doctor blade made of a resin.

Then, in the state in which the grip portions 37 (37*p*1 to 37*p*5) of the doctor blade 36 are held with use of the fingers 101 (101*p*1 to 101*p*5), the device 100 moves each of the fingers 101 in the direction J of FIG. 11. In such a manner, the device 100 gives a force for deflecting at least a part of the area corresponding to the maximum image formable area of the doctor blade 36 to the doctor blade 36 through the grip portions 37 of the doctor blade 36 held with use of the fingers 101. Thus, the grip portions 37 of the doctor blade 36 serve as force receiving portions configured to receive the force applied to the doctor blade 36 from the device 100 for deflecting at least a part of the area corresponding to the maximum image formable area of the doctor blade 36.

Figure 12:
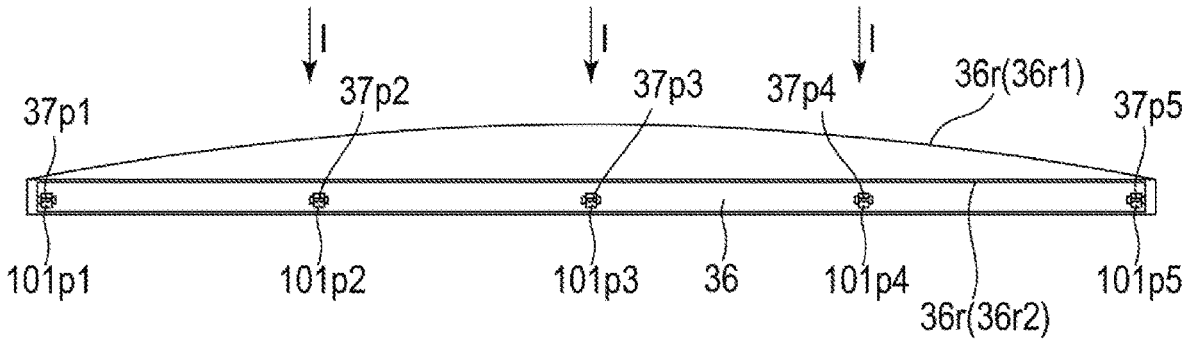
FIG. 12 is a schematic view for illustrating one step of the fixing method for a doctor blade made of a resin.

As illustrated in FIG. 12, the doctor blade 36 (alone) has such a shape that the center portion of the coating amount regulating surface 36*r* of the doctor blade 36 in the longitudinal direction of the doctor blade 36 is significantly deflected. Therefore, it is required that the straightness of the coating amount regulating surface 36*r* of the doctor blade 36 be corrected by reducing the difference in positions of the distal end portions 36*e* (36*c*1 to 36*e*5) of the doctor blade 36. Accordingly, based on the result of measurement of the positions of the distal end portions 36*e* (36*e*1 to 36*e*5) of the doctor blade 36 (outer shape of the coating amount regulating surface 36*r* having been detected), the difference in positions of the distal end portions 36*e* (36*e*1 to 36*e*5) of the doctor blade 36 is reduced. For that purpose, the device 100 gives the force for deflecting at least a part of the area corresponding to the maximum image formable area of the doctor blade 36 (also referred to as "straightness correction force") to the doctor blade 36, to thereby correct the straightness of the coating amount regulating surface 36*r* to be equal to or smaller than 50 μm.

Next, the device 100 holds the grip portions 37 (37*p*1 to 37*p*5) of the doctor blade 36, which has been placed on the placement base 103, with use of the fingers 101 (101*p*1 to 101*p*5). Then, in the state in which the grip portions 37 (37*p*1 to 37*p*5) of the doctor blade 36 are held with use of the fingers 101 (101*p*1 to 101*p*5), the device 100 causes each of the fingers 101 to independently proceed or retreat in the direction J indicated by the arrows in FIG. 11. On this occasion, the device 100 gives the force for deflecting at least a part of the area corresponding to the maximum image formable area of the doctor blade 36 to the doctor blade 36 through the grip portions 37 of the doctor blade 36.

In the example illustrated in FIG. 12, the device 100 gives the straightness correction force to the doctor blade 36 so as to, with the outer shapes of the distal end portions 36*c*1 and 36*e*5 of the doctor blade 36 as references, bring the outer shapes of the distal end portions 36*e*2, 36*e*3, and 36*e*4 into conformity with the references. In the example illustrated in FIG. 12, the doctor blade 36 receives the force for deflecting at least a part of the area corresponding to the maximum image formable area of the doctor blade 36 from the outside through the grip portions 37 (37*p*2 to 37*p*4) located at three positions among five positions. Then, owning to the force received on the doctor blade 36 through the grip portions 37 (37*p*2 to 37*p*4) located at three positions, the straightness correction force for correcting the straightness of the coating amount regulating surface 36*r* acts on the distal end portions 36*e*2 to 36*c*4 of the doctor blade 36 in the direction I indicated by the arrows in FIG. 12. On this occasion, the straightness correction force acts on the coating amount regulating surface 36*r*, and at least a part of the area corresponding to the maximum image formable area of the doctor blade 36 is deflected. Accordingly, the straightness of the coating amount regulating surface 36*r* of the doctor blade 36 is corrected. In the example illustrated in FIG. 12, the shape of the coating amount regulating surface 36*r* of the doctor blade 36 is corrected from the coating amount regulating surface 36*r*1 to the coating amount regulating surface 36*r*2.

As a result, the straightness of the coating amount regulating surface 36*r* of the doctor blade 36 can be corrected to be equal to or smaller than 50 μm. In the example illustrated in FIG. 12, the outer shapes of the distal end portions 36*e*1 and 36*e*5 of the doctor blade 36 were used as the references for bringing the outer shapes of the distal end portions 36*e* of the doctor blade 36 into conformity by the device 100. However, in a modification example, the distal end portion 36*e*3 (that is, the center portion of the coating amount regulating surface 36*r*) may be used as a reference. In this modification example, the device 100 gives the straightness correction force to the doctor blade 36 so as to, with the outer shape of the distal end portion 36*e*3 of the doctor blade 36 as a reference, bring the outer shapes of the distal end portions 36*e*1, 36*e*2, 36*e*4, and 36*e*5 into conformity with the reference.

In this embodiment, in view of practical steps for mass production, a setting value of the straightness correction for the coating amount regulating surface 36*r* of the doctor blade 36 is set within a range of from about 20 μm to about 50 μm, and a magnitude of the straightness correction force caused to act on the distal end portions 36*e* of the doctor blade 36 is set to about 500 g. In general, when the magnitude of the straightness correction force caused to act on the distal end portions 36*e* of the doctor blade 36 is set smaller, the device 100 can be reduced in cost and downsized. However, when the magnitude of the straightness correction force caused to act on the distal end portions 36*e* of the doctor blade 36 is excessively small with respect to the stiffness of the doctor blade 36, the straightness of the coating amount regulating surface 36*r* of the doctor blade 36 cannot be corrected. Therefore, the magnitude of the straightness correction force caused to act on the distal end portions 36*e* of the doctor blade 36 is set based on the stiffness of the doctor blade 36.

In the example illustrated in FIG. 11, the example in which the grip portions 37 are provided at five positions of the doctor blade 36 is described. However, as long as the straightness correction force can be caused to act on the coating amount regulating surface 36*r*, positions and the number of the grip portions 37 provided to the doctor blade 36 are not limited to those described above. Moreover, in the example illustrated in FIG. 11, the example in which the grip portions 37 of the doctor blade 36 each have a projection shape. However, the shape of each of the grip portions 37 is not limited to the projection shape. As described above, in order to allow the device 100 to give the force for deflecting at least a part of the area corresponding to the maximum image formable area of the doctor blade 36 (straightness correction force) to the doctor blade 36, the fingers 101 hold the grip portions 37 of the doctor blade 36. Thus, as long as the fingers 101 can hold the grip portions 37, the shape of each of the grip portions 37 may be a shape other than the projection shape. For example, the shape of each of the grip portions 37 may be a recess shape, a groove shape, a cutout shape, a flat shape, or combinations of those shapes. Among the drawings of the specification, in the drawings in which the doctor blade 36 is illustrated except for FIG. 11, FIG. 12, FIG. 13, FIG. 14A, and FIG. 14B, the grip portions 37 of the doctor blade 36 is omitted.

(2) Positioning Step

Figure 13:
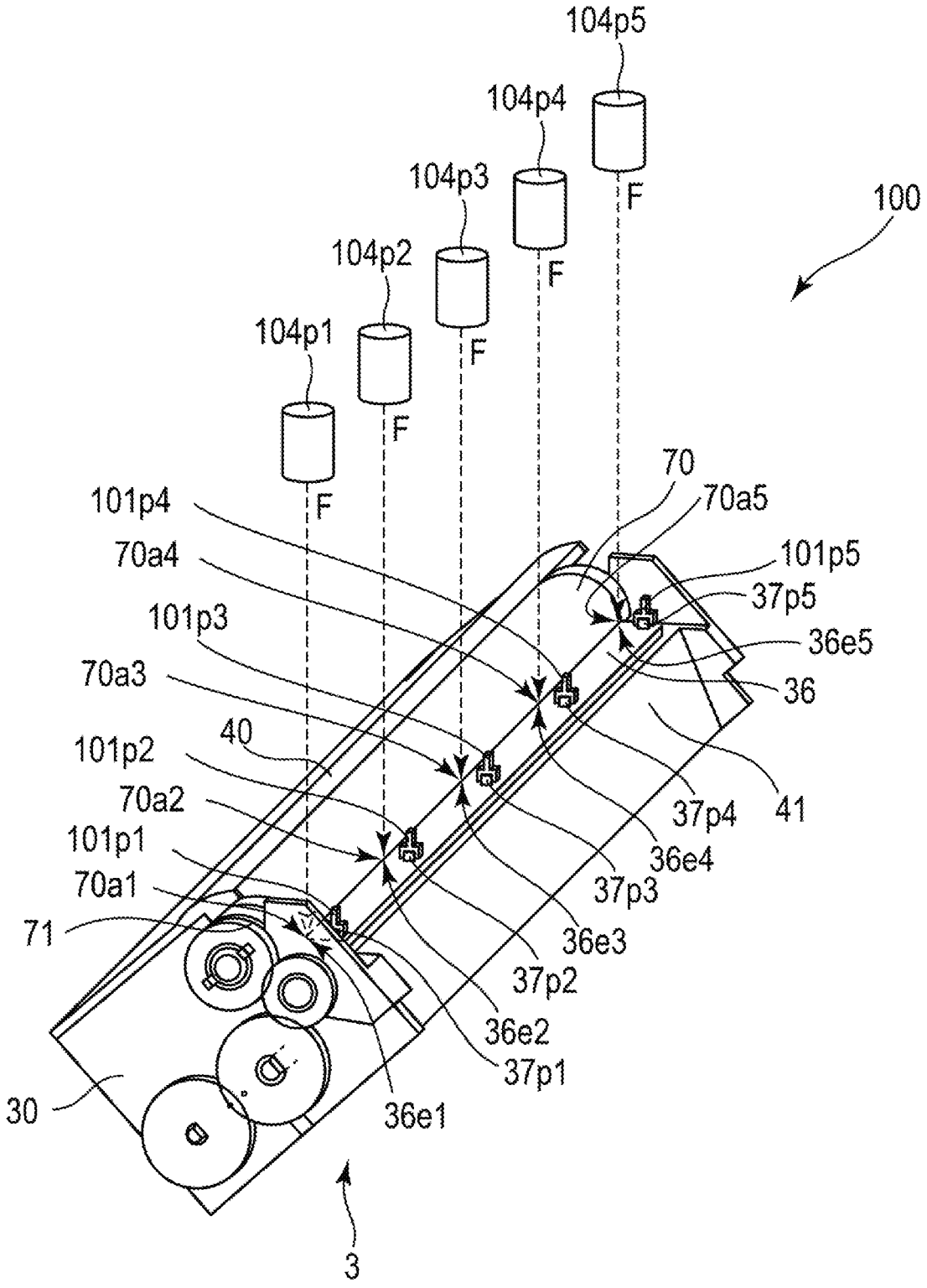
FIG. 13 is a schematic view for illustrating one step of the fixing method for a doctor blade made of a resin.
Figure 14A:
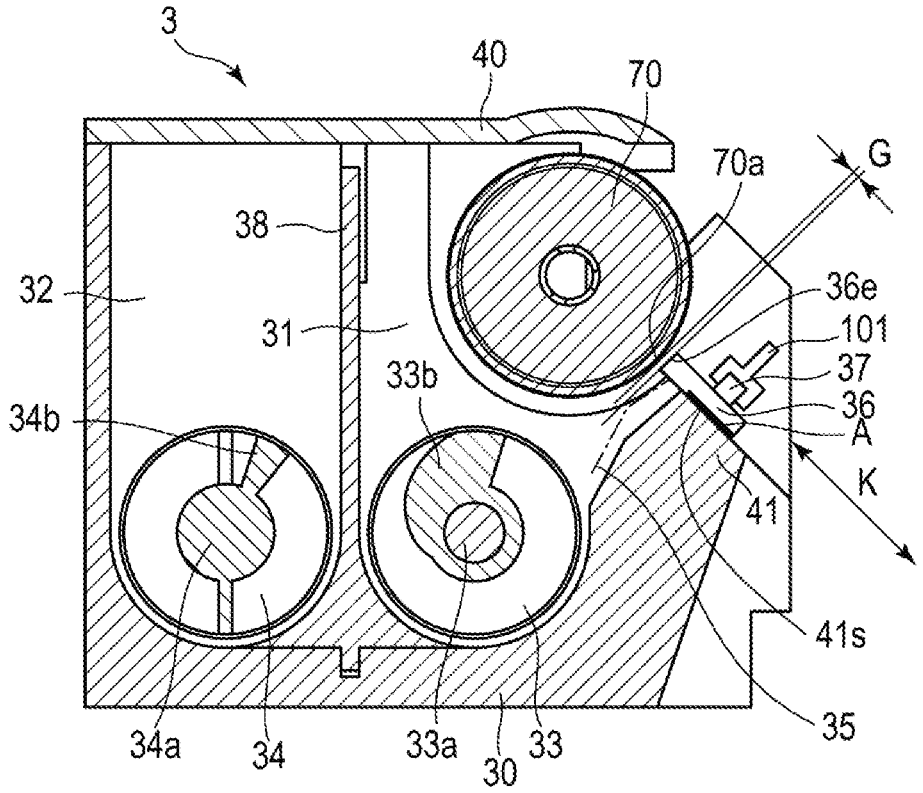
FIG. 14A and FIG. 14B are schematic views for illustrating one step of the fixing method for a doctor blade made of a resin.
Figure 14B:
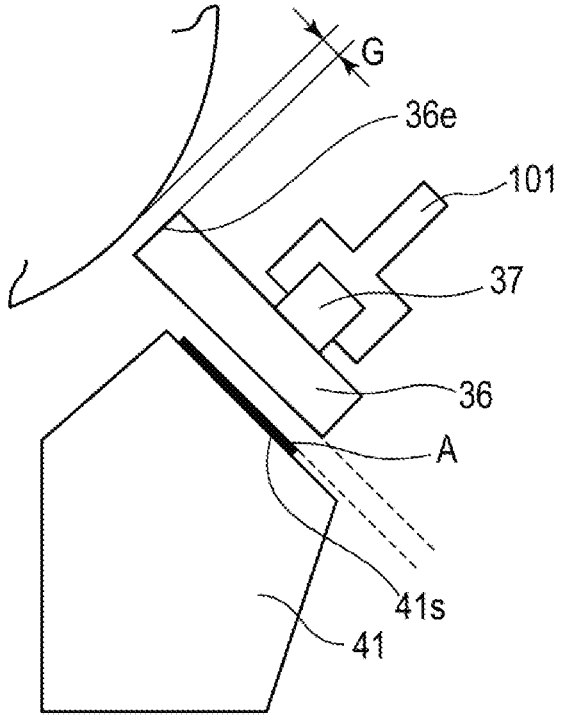

Next, details of the positioning step are described with reference to schematic views of FIG. 13, FIG. 14A, and FIG. 14B. As illustrated in FIG. 13, FIG. 14A, and FIG. 14B, the positioning step is performed in a state in which the developing sleeve 70 is supported by the sleeve supporting portions 42 of the developing frame 30 (that is, in a state in which the developing sleeve 70 is assembled to the developing frame 30). Moreover, the positioning step is performed in a state in which the adhesive A has been applied to the blade mounting surface 41*s*. That is, in this embodiment, an applying step of applying the adhesive A to the blade mounting surface 41*s* is performed prior to the positioning step.

FIG. 14A is a schematic view for illustrating a state in which the grip portions 37 (37*p*1 to 37*p*5) of the doctor blade 36 having been deflected in the deflecting step is held with use of the fingers 101 (101*p*1 to 101*p*5). FIG. 14B is an enlarged view for illustrating a vicinity of the blade mounting surface 41*s* when the doctor blade 36 is held with use of the fingers 101 in a state in which the doctor blade 36 is apart from the blade mounting surface 41*s* having the adhesive A applied thereto and the adhesive A.

The fingers 101 (101*p*1 to 101*p*5) move the doctor blade 36 from the placement base 103 to the blade mounting portion 41 while holding the doctor blade 36 having been deflected in the deflecting step (that is, in a state in which the straightness of the coating amount regulating surface 36*r* has been corrected). A movement amount and a movement direction of each of the fingers 101 (101*p*1 to 101*p*5) are set in advance by a program. The fingers 101 (101*p*1 to 101*p*5) are driven by an actuator and operates in accordance with a program set in advance.

The device 100 moves the doctor blade 36 having been deflected to the blade mounting portion 41 while the grip portions 37 (37*p*1 to 37*p*5) of the doctor blade 36 having been deflected in the deflecting step hold the fingers 101 (101*p*1 to 101*p*5). On this occasion, the device 100 holds the doctor blade 36 in the state in which the doctor blade 36 is apart from the blade mounting surface 41*s* having the adhesive A applied thereto and the adhesive A while the grip portions 37 of the doctor blade 36 having been deflected are held with use of the fingers 101.

For example, a film thickness of the adhesive A having been applied to the blade mounting surface 41*s* of the developing frame 30 is 100 μm. In this case, the doctor blade 36 is held at a position apart from the blade mounting surface 41*s* by several millimeters above the blade mounting surface 41*s* in the vertical direction with a margin from the blade mounting surface 41*s* of the developing frame 30.

As described above, in order to suppress the unevenness in developer amount carried by the surface of the developing sleeve 70 in the longitudinal direction of the developing sleeve 70, the range of the tolerance of the SB gap G (allowable range of the tolerance of the SB gap G with respect to the target value) is set to about 60 μm. As described above, the range of the tolerance of the SB gap G is severe. Therefore, when the doctor blade 36 is simply landed on the blade mounting surface 41*s*, the sizes of the SB gap G are less likely to fall within the adjustment range of the SB gap G (including the target value of the SB gap G) defined in consideration of the range of the tolerance of the SB gap G. Thus, it is required that the sizes of the SB gap G fall within the adjustment range of the SB gap G through determination of a position of fixing the doctor blade 36 with respect to the blade mounting surface 41*s* of the developing frame 30 so that the SB gap G falls within the range of the tolerance.

The device 100 includes cameras 104 (104*p*1 to 104*p*5) located at five positions and configured to measure positions of the distal end portions 36*e* (36*c*1 to 36*e*5) located at five positions on the doctor blade 36 being apart from the blade mounting surface 41*s* having the adhesive A applied thereto and the adhesive A. The cameras 104 (104*p*1 to 104*p*5) are arranged along a direction (direction F indicated by the arrows in FIG. 13) toward the distal end portions 36*c* (36*e*1 to 36*e*5) of the doctor blade 36, and are capable of measuring positions of the distal end portions 36*e* (36*e*1 to 36*e*5) of the doctor blade 36.

<Measurement of Size of SB Gap G>

Now, a measurement method (calculation method) for the sizes of the SB gap G is described. Measurement of the SB gap G is performed in a state in which the developing sleeve 70 is supported on the developing frame 30 and in which the doctor blade 36 is not mounted to the blade mounting portion 41 (in the state in which the doctor blade 36 is apart from the blade mounting surface 41*s* having the adhesive A applied thereto and the adhesive A). Moreover, for the measurement of the sizes of the SB gap G, a light source (for example, LED array or light guide) is inserted into the developing chamber 31 along the longitudinal direction of the developing chamber 31. The light source having been inserted into the developing chamber 31 is configured to radiate light from the inside of the developing chamber 31 to the SB gap G. Then, the cameras 104 (104*p*1 to 104*p*5) image the light beam emitted from the SB gap G to the outside of the developing frame 30.

The cameras 104 are mounted so as to be movable to at least two reference positions including a lowered position and a raised position. The lowered position corresponds to a position at which a focus distance is set on the surface of the developing sleeve 70 close to the distal end portions 36*e* for the state in which the doctor blade 36 is mounted to the blade mounting surface 41*s*. The raised position corresponds to a position at which positions of the distal end portions 36*c* of the doctor blade 36 are read when the doctor blade 36 is held with use of the fingers 101 in the state in which the doctor blade 36 is apart from the blade mounting surface 41*s* having the adhesive A applied thereto and the adhesive A.

First, the cameras 104 (104*p*1 to 104*p*5) read position of the developing sleeve 70 on the surface of the developing sleeve 70 at the lowered position. Next, the cameras 104 (104*p*1 to 104*p*5) are moved from the lowered position to the raised position. The cameras 104 read positions of the distal end portions 36*e* (36*e*1 to 36*e*5) of the doctor blade 36 determined when the doctor blade 36 is held with use of the fingers 101 in the state in which the doctor blade 36 is apart from the blade mounting surface 41*s* having the adhesive A applied thereto and the adhesive A.

Next, the device 100 converts pixel values into distances from image data having been read and generated by the cameras 104 (104*p*1 to 104*p*5). Then, based on position information of the developing sleeve 70 having been read when the cameras 104 are located at the lowered position and position information of the distal end portions 36*e* (36*e*1 to 36*c*5) of the doctor blade 36 having been read when the cameras 104 are located at the raised position, the device 100 calculates the sizes of the SB gap G. When the sizes of the SB gap G having been calculated do not fall within the adjustment range of the SB gap G, the device 100 performs the adjustment of the relative position of the doctor blade 36 with respect to the developing sleeve 70 supported by the developing frame 30. Then, after the relative position of the doctor blade 36 with respect to the developing sleeve 70 supported by the developing frame 30 has been adjusted, the cameras 104 (104*p*1 to 104*p*5) read again the position of the developing sleeve 70 on the surface of the developing sleeve 70 at the lowered position. Then, based on the position information of the developing sleeve 70 having been read when the cameras 104 are located at the lowered position and position information of the distal end portions 36*e* (36*e*1 to 36*e*5) of the doctor blade 36 having been read again when the cameras 104 are located at the raised position, the device 100 calculates again the sizes of the SB gap G. When the sizes of the SB gap G having been calculated again fall within the adjustment range of the SB gap G, the doctor blade 36 is mounted to the blade mounting surface 41*s* having the adhesive A applied thereto, and the routine proceeds to the fixing step described later.

<Correction of Target Value of SB Gap G>

As described above, in the configuration in which the doctor blade 36 made of a resin is fixed to the blade mounting portion 41 of the developing frame 30 made of a resin, it is required that the SB gap G fall within the predetermined range over the longitudinal direction of the developing sleeve 70 irrespective of the flatness of the blade mounting surface 41*s*.

Therefore, in this embodiment, the target value of the SB gap G is determined in consideration of a variation amount of the relative position of the regulating blade with respect to the developing sleeve in accordance with a characteristic related to a shape (profile) of the blade mounting surface of the developing frame. Specifically, in this embodiment, the device 100 uses the cameras 104 (104*p*1 to 104*p*5) illustrated in FIG. 13 to image the blade mounting surface 41*s* of the developing frame 30 and analyzes the characteristic related to the shape (profile) of the blade mounting surface 41*s* of the developing frame 30. Next, with reference to the analysis result, the device 100 corrects the target value of the SB gap G based on the characteristic information related to the shape of the blade mounting surface 41*s*. Next, the device 100 fixes the doctor blade 36 so that the SB gap G falls within the predetermined range over the longitudinal direction of the developing sleeve 70 (including the target value of the SB gap G having been determined based on the characteristic information related to the shape of the blade mounting surface 41*s* having been imaged). In the following, details thereof are described.

The correction of the target value of the SB gap G in this embodiment is described with reference to schematic views of FIG. 15, FIG. 16A, and FIG. 16B. FIG. 16A is an enlarged view of a portion XVIA surrounded by dotted lines in FIG. 15. FIG. 16B is a view for illustrating an example in which a position of the doctor blade 36 of FIG. 16A is changed. In this embodiment, measurement of positions of the distal end portions 36*e* (36*c*1 to 36*e*5) of the doctor blade 36 is performed with use of the cameras 104 (104*p*1 to 104*p*5) illustrated in FIG. 13. In this embodiment, an example in which the cameras 104 are used as a measurement unit configured to measure the sizes of the SB gap G is described below. However, the sizes of the SB gap G may be measured with use of sensors other than the cameras 104 (for example, transmission type sensor).

Figure 15:
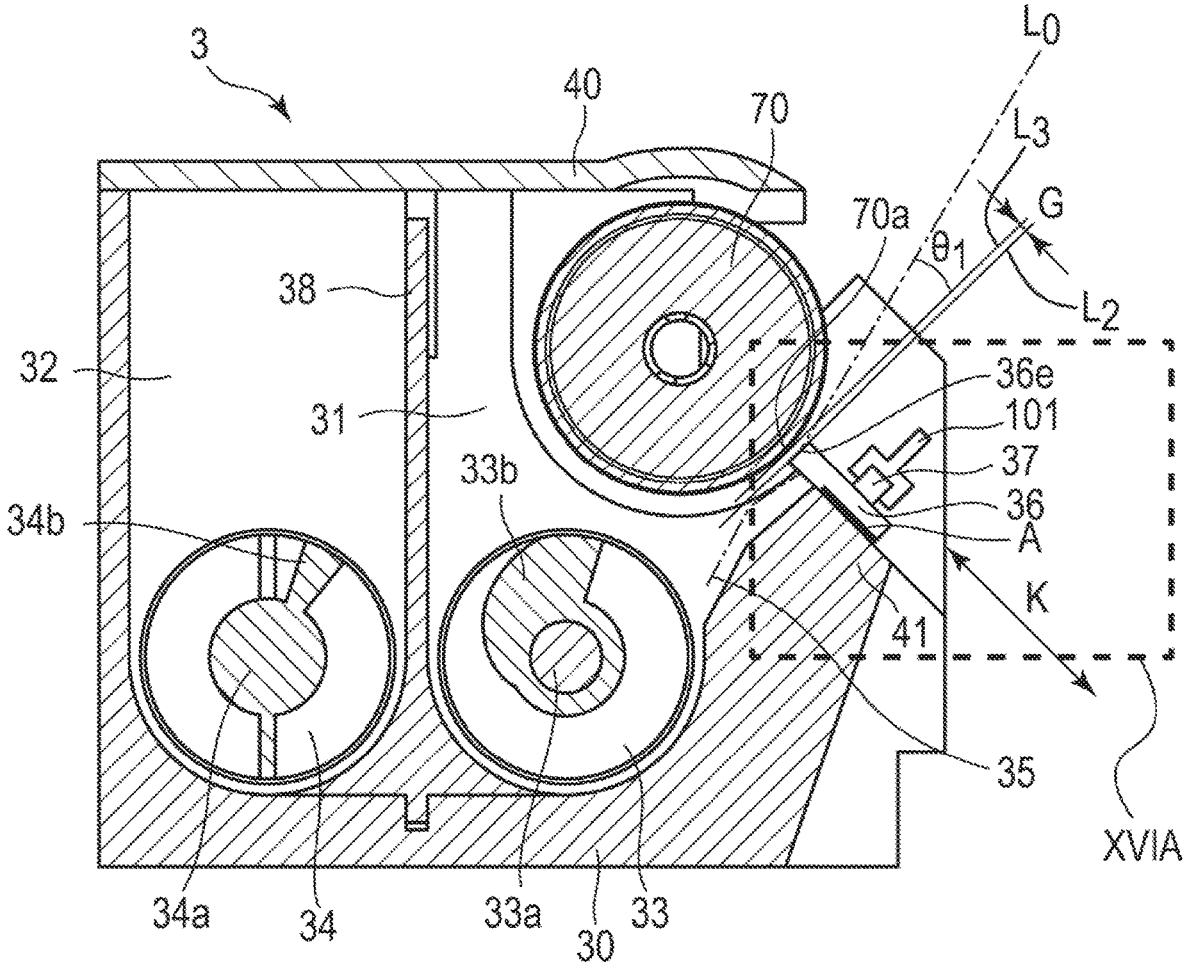
FIG. 15 is a schematic view for illustrating correction of a target value of an SB gap.
Figure 16A:
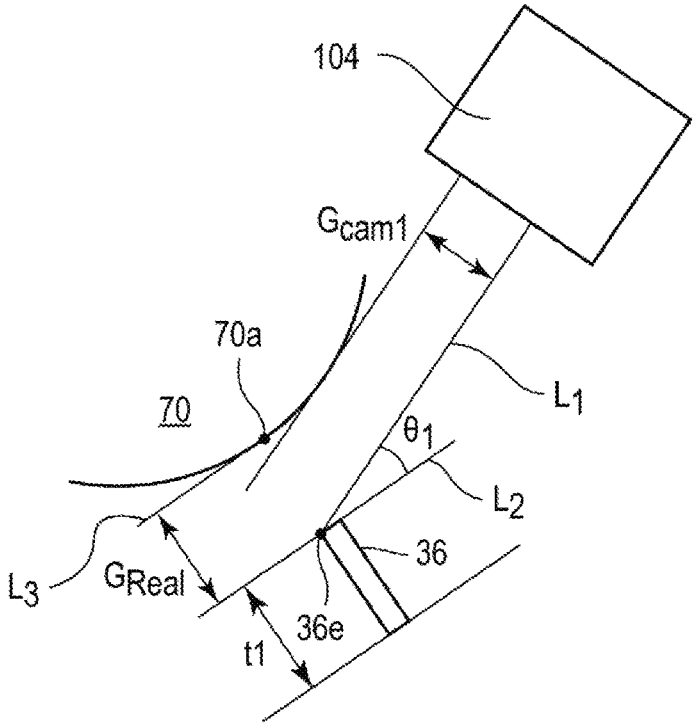
FIG. 16A and FIG. 16B are schematic views for illustrating correction of the target value of the SB gap.
Figure 16B:
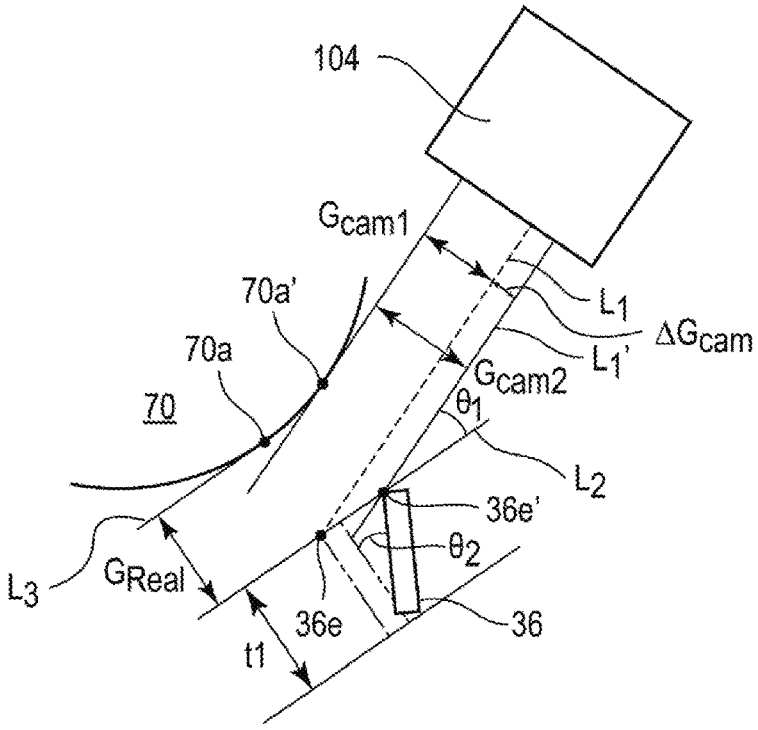

As illustrated in FIG. 15, an optical axis $L_0$ of each of the cameras 104 (104*p*1 to 104*p*5) at the time of measuring the size of the SB gap G is arranged at a predetermined angle with respect to a real SB gap G ($G_{Real}$) described later with reference to FIG. 16A and FIG. 16B. That is, the optical axis $L_0$ of each of the cameras 104 is arranged so as to form an angle θ1 with respect to a straight line $L_2$ being parallel to a tangent line $L_3$ of the developing sleeve 70 that passes through a position 70*a* at which the developing sleeve 70 is closest to the doctor blade 36 and passing through the distal end portions 36*e* of the doctor blade 36. The angle θ1 represents an installation position of each of the cameras 104 in the device 100. Therefore, the angle θ1 is a value unique to the apparatus, and is a setting value.

FIG. 16A is a view for schematically illustrating the blade mounting portion 41 of the developing frame 30 in a design nominal state. A real SB gap G is $G_{Real}$, and an SB gap G measured by each of the cameras 104 (104*p*1 to 104*p*5) is $G_{cam1}$. Similarly to FIG. 15, also in FIG. 16A, each of the cameras 104 (104*p*1 to 104*p*5) is arranged so as to have the angle $\theta_1$ with respect to the straight line $L_2$.

On this occasion, the straight line $L_1$ illustrated in FIG. 16A and the straight line $L_2$ illustrated in FIG. 16A are expressed by the following relational expression (Expression 3). The straight line $L_1$ corresponds to an imaging light beam (optical axis $L_0$ of the camera 104) given by each of the cameras 104 (104*p*1 to 104*p*5) and is a straight line passing through the distal end portions 36*e* of the doctor blade 36.

$$L_1: a_1x+b_1y+c_1=0 \ (a_1,\ b_1,\ \text{and}\ c_1\ \text{are constants})$$

$$L_2: a_2x+b_2y+c_2=0 \ (a_2,\ b_2,\ \text{and}\ c_2\ \text{are constants}) \qquad \text{(Expression 3)}$$

Moreover, when a radius of the developing sleeve 70 is R, a shortest distance from the straight line $L_1$ to the developing sleeve 70 is $G_{cam1}$, and a shortest distance from the straight line $L_2$ to the developing sleeve 70 is $G_{Real}$, a relationship between $G_{cam1}$ and $G_{Real}$ is expressed by the following relational expression (Expression 4).

$$G_{cam1}=(b_2c_1\cos\theta_1-b_1b_2R)/(b_1c_2\cos\theta_1-b_1b_2R)\cdot G_{Real} \qquad \text{(Expression 4)}$$

In this embodiment, with use of the conversion expression (Expression 4) using the angle $\theta_1$ (setting value), the real SB gap $G_{Real}$ is calculated from the value of the SB gap $G_{cam1}$ measured with use of the cameras 104 (104*p*1 to 104*p*5). Then, the doctor blade 36 is fixed so that the real SB gap $G_{Real}$ having been calculated with use of the conversion expression (Expression 4) in accordance with the angle $\theta_1$ falls within the predetermined range (including the target value of the SB gap G) over the longitudinal direction of the developing sleeve 70.

As described above, as the flatness of the blade mounting surface 41*s* of the developing frame 30 becomes larger, a variation amount of the relative position of the doctor blade 36 with respect to the developing sleeve 70, which is determined when the doctor blade 36 is mounted to the blade mounting surface 41*s*, tends to be larger. The relative position of the doctor blade 36 with respect to the developing sleeve 70, which is determined when the doctor blade 36 is mounted to the blade mounting surface 41*s*, includes the position 70*a* at which the doctor blade 36 is closest to the developing sleeve 70.

In the example illustrated in FIG. 16B, inclination variation of an angle $\theta_2$ ($\theta_2$ is variable) is given along the longitudinal direction of the blade mounting portion 41 with respect to the blade mounting portion 41 (example illustrated in FIG. 16A) in the design nominal state. Therefore, in the example illustrated in FIG. 16B, the relative position of the doctor blade 36 with respect to the developing sleeve 70 determined when the doctor blade 36 is mounted to the blade mounting surface 41*s* changes.

In FIG. 16B, specifically, the position of the developing sleeve 70 at which the developing sleeve 70 is closest to the doctor blade 36, which is determined when the doctor blade 36 is mounted to the blade mounting surface 41*s*, is changed from the "position 70*a*" illustrated in FIG. 16A to a "position 70*a*'" illustrated in FIG. 16B. Moreover, the position of the doctor blade 36 at which the doctor blade 36 is closest to the developing sleeve 70, which is determined when the doctor blade 36 is mounted to the blade mounting surface 41*s*, is changed from the "distal end portion 36*e*" illustrated in FIG. 16A to a "distal end portion 36*e*'" illustrated in FIG. 16B.

Moreover, in FIG. 16B, specifically, a straight line which is an imaging light beam given by the cameras 104 (104*p*1 to 104*p*5) and passes through the distal end portions 36*e* (36*e*) of the doctor blade 36 is changed from the straight line $L_1$ illustrated in FIG. 16A to a straight line L1' illustrated in FIG. 16B. As a result, a value of the SB gap $G_{cam1}$ measured with use of the cameras 104 (104*p*1 to 104*p*5) is changed from "$G_{cam1}$" illustrated in FIG. 16A to "$G_{cam2}$" illustrated in FIG. 16B. The "$G_{cam2}$" illustrated in FIG. 16B is an SB gap which is measured with use of the cameras 104 (104*p*1 to 104*p*5) when the inclination variation of the angle $\theta_2$ is given along the longitudinal direction of the blade mounting portion 41 with respect to the blade mounting portion 41 in the design nominal state. When a difference between the value of the SB gap $G_{cam1}$ measured in FIG. 16A and the value of the SB gap $G_{cam2}$ measured in FIG. 16B is $\Delta G_{cam}$, a relationship of $G_{cam1}$, $G_{cam1}$, and $\Delta G_{cam}$ is expressed by the following relational expression (Expression 5).

$$\Delta G_{cam}=G_{cam2}-G_{cam1} \quad \text{(Expression 5)}$$

Moreover, a relationship of $\Delta G_{cam}$, angle $\theta_1$, and angle $\theta_2$ is expressed by the following relational expression (Expression 6). The "$t_1$" given in (Expression 6) is a length (setting value) of the doctor blade 36 in the widthwise direction (see FIG. 5 and FIG. 16B).

$$\Delta G_{cam}=t_1 \sin\theta_1 \tan\theta_2 \quad \text{(Expression 6)}$$

With reference to (Expression 4), (Expression 5), and (Expression 6), a relationship of $G_{cam2}$ and $G_{Real}$ is derived with use of the angle $\theta_1$ and the angle $\theta_2$. A relationship of $G_{cam2}$, $G_{Real}$, angle $\theta_1$, and angle $\theta_2$ is expressed by the following relational expression (Expression 7).

$$G_{cam2}=G_{cam1}+\Delta G_{cam}=(b_2c_1\cos\theta_1-b_1b_2R)/(b_1c_2\cos\theta_1-b_1b_2R)\cdot G_{Real}+t_1\sin\theta_1\tan\theta_2 \quad \text{(Expression 7)}$$

As described above, "$a_1$", "$b_1$", "$c_1$", "$a_2$", "$b_2$", and "$c_2$" are constants, "R" is a radius of the developing sleeve 70, sizes of "angle $\theta_1$" and "$t_1$" are setting values, and a size of "angle $\theta_2$" is a variable. Therefore, when the size of "angle $\theta_2$" determined when the inclination variation of the angle $\theta_2$ along the longitudinal direction of the blade mounting portion 41 is determined with respect to the blade mounting portion 41 in the design nominal state is found, conversion from $G_{Real}$ to $G_{cam2}$ can be performed with use of the conversion expression (Expression 7). Thus, the target value ($G_{cam2}$) of the SB gap G at each point in the longitudinal direction of the blade mounting portion 41 for setting the real SB gap $G_{Real}$ to fall within the predetermined range over the longitudinal direction of the developing sleeve 70 is converted from $G_{Real}$ with use of (Expression 7). In this embodiment, the target value of the SB gap G at each point in the longitudinal direction of the blade mounting portion 41 is corrected in such a manner.

Therefore, in this embodiment, when the doctor blade 36 is to be mounted to the blade mounting surface 41*s*, the blade mounting surface 41*s* of the developing frame 30 is imaged with use of the cameras 104, and a characteristic related to the shape (profile) of the blade mounting surface 41*s* of the developing frame 30 is analyzed. Specifically, the camera 104 measures coordinates of two freely-selected points on the blade mounting surface 41*s* in a cross section (2-dimensional plane) orthogonal to the rotation axis of the developing sleeve 70 and calculates an inclination angle (angle $\theta_2$) from the design nominal state of the blade mounting portion 41 based on the coordinates at two points having been measured. Next, in consideration of the inclination angle from the design nominal state of the blade mounting portion 41 (inclination variation of the angle $\theta_2$ illustrated in FIG. 16B), the target value of the SB gap G at each point in the longitudinal direction of the blade mounting portion 41 is corrected with use of the conversion expression (Expression 7) using the angle $\theta_2$.

In such a manner, in this embodiment, in consideration of the variation amount of the relative position of the doctor blade 36 with respect to the developing sleeve 70 in accordance with the flatness of the blade mounting surface 41*s* of the developing frame 30, the target value of the SB gap G is determined. With this, in consideration of the characteristic related to the shape of the regulating blade mounting surface of the mounting portion of the developing frame made of a resin to which the regulating blade made of a resin is fixed, the SB gap can be set so as to fall within the predetermined range including the target value of the SB gap over the longitudinal direction of the developer carrying member.

<Adjustment of Relative Position of Doctor Blade with Respect to Developing Sleeve>

Now, details of an adjustment method for the relative position of the doctor blade 36 with respect to the developing sleeve 70 supported on the developing frame 30 are described with reference to the schematic view of FIG. 14A. In the state in which the grip portions 37 (37*p*1 to 37*p*5) of the doctor blade 36 are held with use of the fingers 101 (101*p*1 to 101*p*5), the device 100 moves the fingers 101 in the direction K indicated by the arrows illustrated in FIG. 14A. The direction K indicated by the arrows in FIG. 14A is a direction in which the relative position of the doctor blade 36 with respect to the developing sleeve 70 supported on the sleeve supporting portions 42 of the developing frame 30 is adjusted (that is, direction of defining the SB gap G). Moreover, the direction K indicated by the arrows in FIG. 14A indicates a direction in which the doctor blade 36 approaches or leaves the developing sleeve 70 supported on the sleeve supporting portions 42 of the developing frame 30. With this, the relative positions of the distal end portions 36*c* (36*e*1 to 36*c*5) of the doctor blade 36 with respect to the position 70*a* (70*a* to 70*a*5) at which the developing sleeve 70 is closest to the doctor blade 36 on the surface of the developing sleeve 70 are adjusted.

For example, the doctor blade 36 is held with use of the fingers 101 in the state in which the doctor blade 36 is apart from the blade mounting surface 41*s* having the adhesive A applied thereto and the adhesive A. Moreover, at this time, the SB gap G calculated at an initial position measured by one camera 104*p*1 among the cameras 104 (104*p*1 to 104*p*5) located at five positions is 350 μm. Meanwhile, an adjustment range of the SB gap G is 300 μm±30 μm, and the allowable tolerance of the SB gap G is 60 μm at maximum. In this case, at the initial position determined when the doctor blade 36 is held with use of the fingers 101 in the state in which the doctor blade 36 is apart from the blade mounting surface 41*s* having the adhesive A applied thereto and the adhesive A, the SB gap G is larger than a nominal value 300 μm of the SB gap G by 50 μm. Therefore, in the state in which the grip portions 37 of the doctor blade 36 is held with use of the fingers 101, the fingers 101 move the doctor blade 36 in parallel in the direction K indicated by the arrows illustrated in FIG. 14A, that is, a direction of causing the doctor blade 36 to approach the surface of the developing sleeve 70 by 50 μm.

Then, the camera 104*p*1 reads the distal end portion 36*e*1 of the doctor blade 36 having been moved with the finger 101*p*1 in parallel. Next, the device 100 calculates again the SB gap G with regard to the doctor blade 36 having been moved with the finger 101*p*1 in parallel.

When it is determined that the size of the SB gap G calculated at the position of the finger 101*p*1 falls within the range of the adjustment value of the SB gap G (300 μm±30 μm), the device 100 terminates the adjustment of the SB gap G at the position of the finger 101*p*1. As described above with reference to FIG. 16B, the range of the adjustment value of the SB gap G includes the target value of the SB gap G determined based on characteristic information related to the shape of the blade mounting surface 41*s* imaged by the cameras 104 (104*p*1 to 104*p*5).

Meanwhile, when it is determined that the size of the SB gap G having been calculated does not fall within the adjustment range of the SB gap G (300 μm±30 μm), the device 100 repeats the adjustment of the SB gap G described above until the size of the SB gap G falls within the adjustment range of the SB gap G (300 μm±30 μm). The adjustment operation described above is independently performed in parallel at each of five positions of the fingers 101 (101*p*1 to 101*p*5). It is assumed that the device 100 has determined that all of the sizes of the SB gap G having been calculated at five positions of the fingers 101 (101*p*1 to 101*p*5) fall within the range of the adjustment value of the SB gap G (300 μm±30 μm). In this case, the device 100 moves the doctor blade 36 in a direction perpendicular to the adjustment direction with the fingers 101 (101*p*1 to 101*p*5), and causes the doctor blade 36 to be landed on the blade mounting surface 41*s*. After that, the routine proceeds to the fixing step described later.

In order to perform the adjustment of the SB gap with higher accuracy, it is required that not only the straightness of the coating amount regulating surface 36*r* of the doctor blade 36 but also the straightness of the surface of the developing sleeve 70 be taken into consideration. A sleeve pipe forming an outer shell of the developing sleeve 70 is made of metal. Thus, through the secondary machining on the sleeve pipe, the straightness of the surface of the developing sleeve 70 can be set to a high accuracy of equal to or smaller than ±15 μm. However, when the developing sleeve 70 is in a rotation state in actual use, the straightness of ±15 μm of the developing sleeve 70 is taken such that an outer diameter of the developing sleeve 70 changes by ±15 μm in appearance. Therefore, in the positioning step, the fingers 101 performs the following operation while moving the doctor blade 36 in parallel in the direction of causing the doctor blade 36 to approach the surface of the developing sleeve 70. That is, in order to minimize the influence on the SB gap G due to the accuracy of the straightness of the coating amount regulating surface 36*r* of the doctor blade 36 in the rotating state of the developing sleeve 70, the SB gap G is measured while the developing sleeve 70 is being rotated. On this occasion, the doctor blade 36 is in a state of being apart from the blade mounting surface 41*s* having the adhesive A applied thereto and the adhesive A. With this, the adjustment of the SB gap G in consideration of the straightness of the surface of the developing sleeve 70 can be performed with higher accuracy.

(3) Fixing Step

Next, details of the fixing step are described with reference to the schematic view of FIG. 14A. In this embodiment, as illustrated in FIG. 14A, the fixing step is performed in the state in which the doctor blade 36 having been deflected in the deflecting step is landed at a predetermined position of the blade mounting portion 41 of the developing frame 30 having been determined in the positioning step.

When the doctor blade 36 is to be fixed to the blade mounting portion 41 with use of the adhesive A, in order to bond the doctor blade 36 to the blade mounting portion 41 with a sufficient bonding strength, importance is given on a degree of close contact between the doctor blade 36 and the blade mounting portion 41. This is because, when a large gap is defined between the doctor blade 36 and the blade mounting portion 41 at the time of fixing the doctor blade 36 to the blade mounting portion 41 with use of the adhesive A, the bonding strength is small even when the adhesive A is interposed in the gap.

In order to achieve a state in which a desired bonding strength is given between the blade mounting portion 41 and the doctor blade 36 having been landed at a predetermined position of the blade mounting portion 41, it is required that the doctor blade 36 be kept in close contact with the blade mounting portion 41 until the adhesive A is cured. Thus, in the state in which the doctor blade 36 is landed on the blade mounting surface 41*s* of the developing frame 30, the device 100 places a weight having a predetermined weight on the doctor blade 36, to thereby apply a load for bringing the doctor blade 36 into close contact with the blade mounting portion 41. In order to obtain a sufficient bonding strength, it is required that the fingers 101 keep holding the doctor blade 36 in a state in which such a load is kept applied until the adhesive A is sufficiently cured, to thereby hold the doctor blade 36 held in close contact with the blade mounting portion 41. For example, when the curing time of the adhesive A is 15 seconds, it is only required that the load for holding the doctor blade 36 in close contact with the blade mounting portion 41 be applied with a margin in time, that is, for 20 seconds.

After the bonding of the doctor blade 36 to the blade mounting portion 41 has been completed, the device 100 lifts up the weight to remove the load from the doctor blade 36. Then, the device 100 operates the fingers 101 (101*p*1 to 101*p*5) to separate the fingers 101 (101*p*1 to 101*p*5) from the doctor blade 36, and thereafter moves the fingers 101 (101*p*1 to 101*p*5) to preparation positions for the next operation.

In this embodiment, before the doctor blade 36 is landed on the blade mounting surface 41*s* of the developing frame 30, the device 100 applies the adhesive A over substantially the entire region of the area corresponding to the maximum image formable area with respect to the blade mounting surface 41*s*. Then, the device 100 bonds (fixes) the doctor blade 36, which has been deflected in the deflecting step, to the blade mounting portion 41 in substantially the entire region of the area corresponding to the maximum image formable area. On this occasion, the doctor blade 36 is bonded (fixed) to the blade mounting portion 41 in the state in which the straightness of the coating amount regulating surface 36*r* is corrected to be equal to or smaller than 50 μm. As described above, in this embodiment, the area having been deflected to correct the straightness of the coating amount regulating surface 36*r* in the area corresponding to the maximum image formable area of the doctor blade 36 is fixed to the blade mounting portion 41. With this, the area having been deflected to correct the straightness of the coating amount regulating surface 36*r* in the area corresponding to the maximum image formable area of the doctor blade 36 can be prevented from being recovered to the original state before deflection from the state of being deflected.

In the example described with reference to FIG. 11 to FIG. 14B, the example in which the device 100 applies the adhesive A over substantially the entire region of the area corresponding to the maximum image formable area with respect to the blade mounting surface 41*s* before the doctor blade 36 is landed on the blade mounting surface 41*s* of the developing frame 30 is described. Meanwhile, depending on the shape of the blade mounting portion 41, it is conceivable that an area in which it is difficult for the device 100 to apply the adhesive A to the blade mounting surface 41*s* may be present. In such a case, as long as the area having received the force for deflecting at least a part of the area corresponding to the maximum image formable area of the doctor blade 36 is fixed to the blade mounting portion 41 with use of the adhesive A, it is not always required that the adhesive A be applied to a part of the blade mounting surface 41*s*.

The state in which the adhesive A is applied over substantially the entire region of the area corresponding to the maximum image formable area with respect to the blade mounting surface 41*s* satisfies the following condition. Specifically, the area having been deflected to correct the straightness of the coating amount regulating surface 36*r* in the area corresponding to the maximum image formable area of the doctor blade 36 is included, and the adhesive A is applied to an area which is equal to or larger than 95% of the area corresponding to the maximum image formable area in the longitudinal direction of the blade mounting surface 41*s*.

In the example illustrated in FIG. 11 to FIG. 14B, the example in which the adhesive A is applied on the blade mounting portion 41 side is described. However, in a modification example, the adhesive A may be applied to both the blade mounting portion 41 side and the doctor blade 36 side. Moreover, as a timing of applying the adhesive A on the blade mounting portion 41 side, when the application of the adhesive A is performed in parallel with the deflecting step, a total time required for a series of steps of the fixing method for the doctor blade 36 can be shortened. That is, in this example, such a process corresponds to a series of applying the adhesive A to the blade mounting portion 41 of the developing frame 30 while correcting the straightness of the coating amount regulating surface 36*r*. In the example described above with reference to FIG. 11 to FIG. 14B, the step of applying the adhesive A on the blade mounting portion 41 side of the developing frame 30 is performed prior to the positioning step.

In the case in which the applying step is performed prior to the positioning step, when the curing of the adhesive A proceeds faster during the positioning step, the doctor blade 36 cannot be bonded to the blade mounting portion 41 when the doctor blade 36 is landed on the blade mounting portion 41. Therefore, it is required that the positioning step be completed before the curing of the adhesive A proceeds. The time required for curing the adhesive A is determined in accordance with a material of the adhesive A and an application amount of the adhesive A. Therefore, the time required for curing of the adhesive A can be estimated to some extent. Thus, the number of times the adjustment of the SB gap G can be repeatedly performed before the curing of the adhesive A proceeds is determined in advance based on the time required for one adjustment of the SB gap G. Therefore, the adjustment of the SB gap G can be repeatedly performed within the range of the number because the adhesive A has not yet been sufficiently cured.

As described above, in this embodiment, in consideration of the variation amount of the relative position of the regulating blade with respect to the developing sleeve in accordance with the characteristic related to the shape (profile) of the blade mounting surface of the developing frame (frame, the target value of the SB gap is determined. With this, in consideration of the characteristic related to the shape of the regulating blade mounting surface of the mounting portion of the developing frame made of a resin to which the regulating blade made of a resin is fixed, the SB gap can be set so as to fall within the predetermined range including the target value of the SB gap over the longitudinal direction of the developer carrying member.

Other Example Embodiment

The present disclosure is not limited to the embodiment described above. Various modifications (including organic combinations of the embodiments) can be made based on the gist of the present disclosure, and are not excluded from the scope of the present disclosure.

In the embodiment described above, as illustrated in FIG. 1, the image forming apparatus 60 having the configuration in which the intermediate transfer belt 61 is used as the intermediate transfer member is described as an example. However, the present disclosure is not limited to this. The present disclosure is applicable also to an image forming apparatus having a configuration in which transfer is performed by sequentially bringing recording materials into direct contact with the photosensitive drum 1.

Moreover, in the embodiment described above, the developing device 3 is provided as a single unit. However, a similar effect can be attained even in a mode of a process cartridge in which the image forming portion 600 (see FIG. 1) including the developing device 3 is integrally formed into a unit and is mountable to and removable from the image forming apparatus 60. Further, as long as the image forming apparatus 60 includes the developing device 3 or the process cartridge, the present disclosure can be applied irrespective of whether the image forming apparatus 60 is a monochrome machine or a color machine.

According to the present disclosure, in consideration of the characteristic related to the shape (profile) of the surface of the mounting portion of the developing frame made of a resin to which the regulating blade made of a resin on which the regulating blade is mounted, the SB gap can be set within the predetermined range over the longitudinal direction of the developer carrying member.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-227473, filed Dec. 4, 2018, which is hereby incorporated by reference herein in its entirety.

What is claimed is:

1. A method of manufacturing a developing device including a developer carrying member configured to carry developer to a developing position, a regulating blade made of resin and configured to regulate an amount of the developer carried on the developer carrying member, and a developing frame made of a resin and configured to support the developer carrying member, the developing frame including an attaching portion to which the regulating blade is to be attached, the method comprising:

a first imaging step of imaging the developing frame in a state that the regulating blade is not attached to the attaching portion;

an estimating step of estimating position information of the attaching portion based on an imaging result by the first imaging step;

a determining step of determining a target value of a gap between the developer carrying member supported by the developing frame and the regulating blade attached to the attaching portion based on the position information of the attaching portion estimated by the estimating step;

a second imaging step of imaging the developing frame in a state that the regulating blade is set to the developer carrying member supported by the developing frame;

an adjusting step of adjusting a position of the regulating blade with respect to the developer carrying member supported by the developing frame based on an imaging result by the second imaging step and the target value determined by the determining step; and an attaching step of attaching the regulating blade to the attaching portion in a state that a position of the regulating blade with respect to the developer carrying member supported by the developing frame is adjusted by the adjusting step.

2. The method according to claim 1, wherein, in a case where the gap is represented by g the target value of the gap is represented by $g_{target}$, $g_{target}$ satisfies:

$$0.9\times g\leq g_{target}\leq 1.1\times g.$$

3. The method according to claim 1, wherein the second imaging step includes a step of imaging the developing frame in a state that the regulating blade is not attached to the attaching portion and the regulating blade is set to the developer carrying member supported by the developing frame.

4. The method according to claim 1, further comprising an application step of applying an adhesive to the attaching portion, wherein the attaching step includes a step of fixing the regulating blade to the attaching portion using the adhesive applied to the attaching portion by the application step.

5. The method according to claim 4, wherein the second imaging step includes a step of imaging the developing frame in a state that the regulating blade is not attached to the attaching portion to which the adhesive is applied by the application step and the regulating blade is set to the developer carrying member supported by the developing frame.

6. The method according to claim 1, further comprising an application step of applying an adhesive to the regulating blade, wherein the attaching step includes a step of attaching the regulating blade to the attaching portion using the adhesive applied to the regulating blade by the application step.

7. The method according to claim 1, wherein the first imaging step includes a step of imaging the developing frame using an imaging unit set outside the developing frame, and wherein the determining step includes a step of determining the target value based on position information of the imaging unit and the position information of the attaching portion estimated by the estimating step.

8. The method according to claim 1, wherein the second imaging step includes a step of imaging the developing frame using an imaging unit set outside the developing frame, and wherein a magnitude of the gap is calculated by radiating light from inside the developing frame toward the gap by a light source set inside the developing frame, and then by capturing light exiting from the gap to outside of the developing frame by the imaging unit.

9. The method according to claim 1, wherein the adjusting step includes a step of adjusting the position of the regulating blade with respect to the developer carrying member supported by the developing frame by imparting a force, for warping the regulating blade, to the regulating blade; and wherein the attaching step includes a step of attaching the regulating blade to the attaching portion in a state that the regulating blade is kept warped by the force imparted to the regulating blade.

10. The method according to claim 1, wherein, in a case where the gap at a center portion of a region of the regulating blade corresponding to a maximum image region of an image bearing member is represented by $g_1$, the gap at one end portion of the region of the regulating blade corresponding to the maximum image region of the image bearing member is represented by $g_2$, the gap at the other end portion of the region of the regulating blade corresponding to the maximum image region of the image bearing member is represented by $g_3$, the target value of the gap at the center portion of the region of the regulating blade corresponding to the maximum image region of the image bearing member is represented by $g_{target1}$, the target value of the gap at the one end portion of the region of the regulating blade corresponding to the maximum image region of the image bearing member is represented by $g_{target2}$, and the target value of the gap at the other end portion of the region of the regulating blade corresponding to the maximum image region of the image bearing member is represented by $g_{target3}$, the followings are satisfied:

$$0.9\times g_1\leq g_{target1}\leq 1.1\times g_1;$$

$$0.9\times g_2\leq g_{target2}\leq 1.1\times g_2;\text{ and}$$

$$0.9\times g_3\leq g_{target3}\leq 1.1\times g_3.$$

* * * * *